US008071957B1

(12) United States Patent
Ludwig et al.

(10) Patent No.: US 8,071,957 B1
(45) Date of Patent: Dec. 6, 2011

(54) SOFT CHEMICAL IONIZATION SOURCE

(75) Inventors: John Henry Ludwig, Glen Burnie, MD (US); Timothy Paul Karpetsky, Towson, MD (US); Daniel Lee Schwarz, Timonium, MD (US); Stephen Charles Hope, Bel Air, MD (US)

(73) Assignee: Science Applications International Corporation, San Diego, CA (US)

( * ) Notice: Subject to any disclaimer, the term of this patent is extended or adjusted under 35 U.S.C. 154(b) by 258 days.

(21) Appl. No.: 12/400,831

(22) Filed: Mar. 10, 2009

(51) Int. Cl.
*H01J 27/00* (2006.01)

(52) U.S. Cl. ..... 250/424; 250/282; 250/288

(58) Field of Classification Search ..... 250/424
See application file for complete search history.

(56) References Cited

U.S. PATENT DOCUMENTS

| | | | | |
|---|---|---|---|---|
| 3,708,661 | A * | 1/1973 | Hansen et al. | 250/324 |
| 4,000,918 | A | 1/1977 | Reker | 285/93 |
| 4,159,423 | A | 6/1979 | Kambara | 250/423 R |
| 4,209,696 | A | 6/1980 | Fite | 250/281 |
| 4,256,335 | A | 3/1981 | Nielsen, Jr. | 285/250 |
| 4,271,357 | A | 6/1981 | Bradshaw et al. | 250/287 |
| 4,300,004 | A | 11/1981 | Wissner et al. | 570/211 |
| 4,318,028 | A | 3/1982 | Perel et al. | 315/111.81 |
| 4,468,468 | A | 8/1984 | Benninghoven et al. | 436/173 |
| 4,531,056 | A | 7/1985 | Labowsky et al. | 250/288 |
| 4,542,293 | A | 9/1985 | Fenn et al. | 250/288 |
| 4,546,253 | A | 10/1985 | Tsuchiya et al. | 250/288 |
| 4,789,783 | A | 12/1988 | Cook | 250/379 |
| 4,855,595 | A | 8/1989 | Blanchard | 250/287 |
| 4,888,482 | A * | 12/1989 | Kato | 250/281 |
| 4,948,962 | A | 8/1990 | Mitsui et al. | 250/288 |
| 4,974,648 | A | 12/1990 | Propst | 144/24.13 |
| 4,976,920 | A | 12/1990 | Jacob | 422/23 |
| 4,977,320 | A | 12/1990 | Chowdhury et al. | 250/288 |
| 4,999,492 | A | 3/1991 | Nakagawa | 250/281 |
| 5,141,532 | A | 8/1992 | Sacks et al. | 95/87 |
| 5,142,143 | A | 8/1992 | Fite et al. | 250/288 |
| 5,164,704 | A | 11/1992 | Steen et al. | 340/539.17 |

(Continued)

FOREIGN PATENT DOCUMENTS

GB 2127212 4/1984

(Continued)

OTHER PUBLICATIONS

Application as Filed for U.S. Appl. No. 11/987,632, filed Dec. 3, 2007, 46 pp. Application as Filed for U.S. Appl. No. 11/455,334, filed Jun. 19, 2006, 10 pp.
Application as Filed for U.S. Appl. No. 11/544,252, filed Oct. 7, 2006, 49 pp.
Application as Filed for U.S. Appl. No. 11/594,401, filed Nov. 8, 2006, 23 pp.

(Continued)

*Primary Examiner* — Phillip A Johnston
(74) *Attorney, Agent, or Firm* — King & Spalding LLP

(57) ABSTRACT

A soft chemical ionization source can be small, require low power, reliably produce different ions depending on the operating conditions and configuration, and produce ions that ionize many sample chemicals in different phases in air, or solutions, or on surfaces. In one embodiment, an ionization source is comprised of a housing having a center post extending therefrom, a plurality of needles extending from the housing, and a counterelectrode extending around the housing. The plurality of needles and the counterelectrode are each coupled to an electrical supply. The center post and the plurality of needles extend through the counterelectrode. A voltage applied to the plurality of needles and the counterelectrode forms a gas discharge. By changing the dimensional or electrical characteristics of the ionization source elements, singularly, or relative to other sources in an array, the types, ratios among, and quantities of reagent ions can be changed and controlled.

8 Claims, 28 Drawing Sheets

U.S. PATENT DOCUMENTS

| | | | | |
|---|---|---|---|---|
| 5,168,068 | A | 12/1992 | Yanagisawa et al. | 436/134 |
| 5,171,525 | A | 12/1992 | Jacob | 422/23 |
| 5,192,865 | A | 3/1993 | Zhu | 250/288 |
| 5,280,175 | A | 1/1994 | Karl | 250/287 |
| 5,304,797 | A | 4/1994 | Irie et al. | 250/287 |
| 5,305,015 | A | 4/1994 | Schantz et al. | 347/47 |
| 5,306,910 | A | 4/1994 | Jarrell et al. | 250/286 |
| 5,338,931 | A | 8/1994 | Spangler et al. | 250/287 |
| 5,412,208 | A | 5/1995 | Covey et al. | 250/288 |
| 5,412,209 | A | 5/1995 | Otaka et al. | 250/310 |
| 5,436,446 | A | 7/1995 | Jarrell et al. | 250/288 |
| 5,485,016 | A | 1/1996 | Irie et al. | 250/288 |
| 5,541,519 | A | 7/1996 | Stearns et al. | 324/464 |
| 5,559,326 | A | 9/1996 | Goodley et al. | 250/288 |
| 5,581,081 | A | 12/1996 | Kato et al. | 250/288 |
| 5,587,581 | A | 12/1996 | Stroosnyder | 250/287 |
| 5,625,184 | A | 4/1997 | Vestal et al. | 250/287 |
| 5,684,300 | A * | 11/1997 | Taylor et al. | 250/286 |
| 5,736,740 | A | 4/1998 | Franzen | 250/288 |
| 5,747,799 | A | 5/1998 | Franzen | 250/288 |
| 5,750,988 | A | 5/1998 | Apffel et al. | 250/288 |
| 5,753,910 | A | 5/1998 | Gourley et al. | 250/288 |
| 5,756,994 | A | 5/1998 | Bajic | 250/288 |
| 5,798,146 | A | 8/1998 | Murokh et al. | 427/458 |
| 5,828,062 | A | 10/1998 | Jarrell et al. | 250/288 |
| 5,838,002 | A | 11/1998 | Sheehan | 250/288 |
| 5,873,523 | A | 2/1999 | Gomez et al. | 239/3 |
| 5,892,364 | A | 4/1999 | Monagle | 324/464 |
| 5,903,804 | A | 5/1999 | Kirkpatrick et al. | 399/154 |
| 5,945,678 | A | 8/1999 | Yanagisawa | 250/423 F |
| 5,965,884 | A | 10/1999 | Laiko et al. | 250/288 |
| 5,986,259 | A | 11/1999 | Hirabayachi et al. | 250/288 |
| 6,040,575 | A | 3/2000 | Whitehouse et al. | 250/288 |
| 6,060,705 | A | 5/2000 | Whitehouse et al. | 250/288 |
| 6,107,628 | A | 8/2000 | Smith et al. | 250/292 |
| 6,124,675 | A | 9/2000 | Bertrand et al. | 315/111.91 |
| 6,147,345 | A | 11/2000 | Willoughby | 250/288 |
| 6,204,500 | B1 | 3/2001 | Whitehouse et al. | 250/287 |
| 6,207,954 | B1 | 3/2001 | Andrien, Jr. et al. | 250/288 |
| 6,223,584 | B1 | 5/2001 | Mustacich et al. | 73/23.41 |
| 6,225,623 | B1 | 5/2001 | Turner et al. | 250/286 |
| 6,239,428 | B1 | 5/2001 | Kunz | 250/287 |
| 6,278,111 | B1 | 8/2001 | Sheehan et al. | 250/288 |
| 6,309,610 | B1 | 10/2001 | Nejezchleb et al. | 422/186.04 |
| 6,359,275 | B1 | 3/2002 | Bertsch et al. | 250/281 |
| 6,455,846 | B1 | 9/2002 | Prior et al. | 250/288 |
| 6,462,338 | B1 | 10/2002 | Inatsugu et al. | 250/292 |
| 6,465,776 | B1 | 10/2002 | Moini et al. | 250/285 |
| 6,486,469 | B1 | 11/2002 | Fischer et al. | 250/288 |
| 6,495,823 | B1 | 12/2002 | Miller et al. | 250/286 |
| 6,512,224 | B1 | 1/2003 | Miller et al. | 250/286 |
| 6,534,765 | B1 | 3/2003 | Robb et al. | 250/288 |
| 6,537,817 | B1 | 3/2003 | Papen | 436/49 |
| 6,583,407 | B1 | 6/2003 | Fischer et al. | 250/288 |
| 6,583,408 | B2 | 6/2003 | Smith et al. | 250/288 |
| 6,593,570 | B2 | 7/2003 | Li et al. | 250/290 |
| 6,600,155 | B1 | 7/2003 | Andrien, Jr. et al. | 250/287 |
| 6,610,986 | B2 | 8/2003 | Hartley | 250/423 R |
| 6,649,907 | B2 | 11/2003 | Ebeling et al. | 250/288 |
| 6,683,301 | B2 | 1/2004 | Whitehouse et al. | 250/288 |
| 6,690,004 | B2 | 2/2004 | Miller et al. | 250/286 |
| 6,727,496 | B2 | 4/2004 | Miller et al. | 250/287 |
| 6,744,041 | B2 | 6/2004 | Sheehan et al. | 250/283 |
| 6,750,449 | B2 | 6/2004 | Marcus | 250/288 |
| 6,784,424 | B1 | 8/2004 | Willoughby et al. | 250/292 |
| 6,815,668 | B2 | 11/2004 | Miller et al. | 250/286 |
| 6,818,889 | B1 | 11/2004 | Sheehan et al. | 250/288 |
| 6,822,225 | B2 | 11/2004 | Xu et al. | 250/287 |
| 6,852,969 | B2 | 2/2005 | Marcus et al. | 250/288 |
| 6,852,970 | B2 | 2/2005 | Yamada et al. | 250/288 |
| 6,867,415 | B2 | 3/2005 | Hughey et al. | 250/288 |
| 6,878,930 | B1 | 4/2005 | Willoughby et al. | 250/281 |
| 6,888,132 | B1 | 5/2005 | Sheehan et al. | 250/288 |
| 6,914,243 | B2 | 7/2005 | Sheehan et al. | 250/288 |
| 6,943,347 | B1 | 9/2005 | Willoughby et al. | 250/288 |
| 6,949,740 | B1 | 9/2005 | Sheehan et al. | 250/288 |
| 6,949,741 | B2 | 9/2005 | Cody et al. | 250/288 |
| 6,972,407 | B2 | 12/2005 | Miller et al. | 250/287 |
| 6,998,605 | B1 | 2/2006 | Frazer et al. | 250/281 |
| 7,005,634 | B2 | 2/2006 | Shiokawa et al. | 250/288 |
| 7,041,966 | B2 | 5/2006 | Frazer et al. | 250/281 |
| 7,053,367 | B2 | 5/2006 | Tobita et al. | 250/288 |
| 7,057,168 | B2 | 6/2006 | Miller et al. | 250/287 |
| 7,060,976 | B2 | 6/2006 | Sheehan et al. | 250/288 |
| 7,064,320 | B2 | 6/2006 | Yamada et al. | 250/288 |
| 7,078,068 | B2 | 7/2006 | Book | 426/140 |
| 7,083,112 | B2 | 8/2006 | Ivri | 239/4 |
| 7,087,898 | B2 | 8/2006 | Willoughby et al. | 250/288 |
| 7,091,493 | B2 | 8/2006 | Hiraoka | 250/425 |
| 7,095,019 | B1 | 8/2006 | Sheehan et al. | 250/288 |
| 7,112,785 | B2 | 9/2006 | Laramee et al. | 250/288 |
| 7,112,786 | B2 | 9/2006 | Russ, IV et al. | 250/288 |
| 7,138,626 | B1 | 11/2006 | Karpetsky | 250/288 |
| 7,253,406 | B1 | 8/2007 | Sheehan et al. | 250/288 |
| 7,259,368 | B2 | 8/2007 | Frazer et al. | 250/281 |
| 7,274,015 | B2 | 9/2007 | Miller et al. | 356/508 |
| 7,429,731 | B1 | 9/2008 | Karpetsky | 250/288 |
| 7,576,322 | B2 | 8/2009 | Karpetsky et al. | 250/288 |
| 7,586,092 | B1 | 9/2009 | Karpetsky | 250/288 |
| 2002/0011560 | A1 | 1/2002 | Sheehan et al. | 250/283 |
| 2002/0175278 | A1 | 11/2002 | Whitehouse | 250/281 |
| 2002/0185593 | A1 | 12/2002 | Doring | 250/287 |
| 2002/0185595 | A1 | 12/2002 | Smith et al. | 250/288 |
| 2003/0034452 | A1 | 2/2003 | Fischer et al. | 250/288 |
| 2003/0038236 | A1 | 2/2003 | Russ, IV et al. | 250/288 |
| 2003/0197121 | A1 | 10/2003 | Turecek et al. | 250/281 |
| 2004/0161856 | A1 | 8/2004 | Handly | 436/177 |
| 2004/0245458 | A1 | 12/2004 | Sheehan et al. | 250/288 |
| 2005/0056775 | A1 | 3/2005 | Cody et al. | 250/281 |
| 2005/0196871 | A1 | 9/2005 | Cody et al. | 436/173 |
| 2006/0249671 | A1 | 11/2006 | Karpetsky | 250/288 |
| 2007/0084999 | A1 | 4/2007 | Miller et al. | 250/288 |
| 2007/0114389 | A1 | 5/2007 | Karpetsky et al. | 250/288 |
| 2008/0296493 | A1 | 12/2008 | Willoughby et al. | 250/288 |
| 2009/0294660 | A1 * | 12/2009 | Whitehouse et al. | 250/288 |
| 2010/0059689 | A1 | 3/2010 | Horiike et al. | 250/425 |

FOREIGN PATENT DOCUMENTS

| | | |
|---|---|---|
| GB | 2288061 | 10/1995 |
| JP | 04215329 | 8/1992 |
| JP | 05203637 | 8/1993 |
| JP | 10088798 | 4/1998 |
| WO | WO 93/14515 | 7/1993 |
| WO | WO 98/07505 | 2/1998 |
| WO | WO 99/63576 | 12/1999 |
| WO | WO 00/08455 | 2/2000 |
| WO | WO 00/08456 | 2/2000 |
| WO | WO 00/08457 | 2/2000 |
| WO | WO 01/33605 A2 | 5/2001 |
| WO | WO 01/33605 A3 | 5/2001 |
| WO | WO 03/010794 | 2/2003 |
| WO | WO 2004/098743 | 11/2004 |
| WO | WO 2004/110583 | 12/2004 |
| WO | WO 2006/011171 | 2/2006 |
| WO | WO 2006/122121 | 11/2006 |
| WO | WO 2008/054393 | 5/2008 |

OTHER PUBLICATIONS

Application as Filed for U.S. Appl. No. 12/153,358, filed May 16, 2008, 46 pp.

Application as Filed for U.S. Appl. No. 12/200,941, filed Aug. 29, 2008, 21 pp.

Application as Filed for U.S. Appl. No. 12/344,872, filed Dec. 29, 2008, 39 pp.

Hanson, Eric, "How an Ink Jet Printer Works" [online], [retrieved on May 15, 2008], 5 pp., Retrieved from the Internet: http://www.imaging.org/resources/web_tutorials/inkjet_files/inkjet.cfm.

Le, Hue P., "Progress and Trends in Ink-Jet Printing Technology" [online], *Journal of Imaging Science and Technology*, vol. 42, No. 1, Jan./Feb., 1998 [retrieved on May 15, 2008], 28 pp, Retrieved from the Internet: http://www.imaging.org/resources/web_tutorials/inkjet.cfm.

Chemi-Ionization—Mass Spectrometry Terms, "Chemi-Ionization" [online], Dec. 26, 2005 [retrieved on Apr. 28, 2006], 1 p., Retrieved from the Internet: http://www.msterms.com/wiki/index.php?title=Chemi-Ionization.

Scott, R.P.W., "Gas Chromatography Detectors" [online], Part of the Chrom. Ed. Series, Subsection: Thermal Argon Detector, Copyright 2002-2005 [retrieved on Apr. 28, 2006], 7 pp., Retrieved from the Internet: http://www.chromatography-online.org/GC-Detectors/Ionization-Detectors/Thermal-Argon/rs61.html.
Scott, R.P.W., "Gas Chromatography Detectors" [online], Part of the Chrom. Ed. Series, Subsection: Macro Argon Detector, Copyright 2002-2005 [retrieved on Apr. 28, 2006], 10 pp., Retrieved from the Internet: http://www.chromatography-online.org/GC-Detectors/Ionization-Detectors/Macro-Argon/rs54.html.
Scott, R.P.W., "Gas Chromatography Detectors" [online], Part of the Chrom. Ed. Series, Subsection: Micro Argon Detector, Copyright 2002-2005 [retrieved on May 11, 2006], 6 pp., Retrieved from the Internet: http://www.chromatography-online.org/GC-Detectors/Ionization-Detectors/Micro-Argon/rs59.html.
Scott, R.P.W., "Gas Chromatography Detectors" [online], Part of the Chrom. Ed. Series, Subsection: The Helium Detector, Copyright 2002-2005 [retrieved on Apr. 28, 2006], 8 pp., Retrieved from the Internet: http://www.chromatography-online.org/GC-Detectors/Ionization-Detectors/Helium/rs64.html.
Laroussi, M., and Lu, X., "Room-Temperature Atmospheric Pressure Plasma Plume for Biomedical Applications," *Applied Physics Letters* 87, 113902, Sep. 8, 2005.
Akishev, Yu, et al., "Negative Corona, Glow and Spark Discharges in Ambient Air and Transitions Between Them," *Plasma Sources Sci. Technol.*, vol. 14, pp. S18-S25 (2005).
Willoughby, Ross C., et al., "Transmission of Ions Through Conductance Pathways from Atmospheric Pressure," *Proceedings of the 52nd ASMS Conference on Mass Spectrometry and Allied Topics*, Nashville, Tennessee, 2 pp., May 23-27, 2004.
Sheehan, Edward W., et al., "Atmospheric Pressure Focusing," *Proceedings of the 52nd ASMS Conference on Mass Spectrometry and Allied Topics*, Nashville, Tennessee, 2 pp., May 23-27, 2004.
Benocci, R., et al., "I-V Characteristics and Photocurrents of a He Corona Discharge Under Flow Conditions," *J. Phys. D: Appl. Phys.*, vol. 37, pp. 709-714 (2004).
Bokman, C. Fredrik, "Analytical Aspects of Atmospheric Pressure Ionization in Mass Spectrometry," Acta Universitatis Upsaliensis, *Comprehensive Summaries of Uppsala Dissertations from the Faculty of Science and Technology*, vol. 748, 46 pp., 2002.
Willoughby, R., Sheehan, E., Mitrovich, A., "A Global View of LC/MS," Global View Publishing, pp. 64-65, 470-471, Copyright 2002.
Stach, J., et al., "Ion Mobility Spectrometry—Basic Elements and Applications," *International Journal for Ion Mobility Spectrometry*, IJIMS 5(2002)1, pp. 1-21, 2002.
Hanley, Luke, et al., "Surface Mass Spectrometry of Molecular Species," *Journal of Mass Spectrometry*, vol. 34, pp. 705-723 (1999).
Steinfeld, Jeffrey I., et al., "Explosives Detection: A Challenge for Physical Chemistry," *Annual Review of Physical Chemistry*, vol. 49, pp. 203-232, Oct. 1998.
Lin, B., Sunner, J., "Ion Transport by Viscous Gas Flow Through Capillaries," *J. Am. Soc. Mass Spectrom. 5*, pp. 873-885 (1994).
Potjewyd, J., "Focusing of Ions in Atmospheric Pressure Gases Using Electrostatic Fields," Ph.D. Thesis, University of Toronto (1983).
Mahoney, J. F., et al., "A Theoretical and Experimental Basis for Producing Very High Mass Biomolecular Ions by Electrohydrodynamic Emission," *22nd IEEE Industry Applications Society Annual Metting*, Atlanta, Georgia, Oct. 18-23, 1987.
Olivares, J. A., et al., "On-Line Mass Spectrometric Detection for Capillary Zone Electrophoresis," *Anal. Chem. 59*, pp. 1230-1232 (1987).
Lee, T. D., et al., "An EHD Source for the Mass Spectral Analysis of Peptides," *Proceedings of the 36th ASMS Conference on Mass Spectrometry and Allied Topics*, San Francisco, California, Jun. 5-10, 1988.
Smith, R. D., et al., "Capillary Zone Electrophoresis-Mass Spectrometry Using an Electrospray Ionization Interface," *Anal. Chem. 60*, pp. 436-441 (1988).
Lee, T. D., et al. "Electrohydrodynamic Emission Mass Spectra of Peptides," *Proceedings of the 37th ASMS Conference on Mass Spectrometry and Allied Topics*, Miami Beach, Florida, May 21-26, 1989.
Mahoney, J. F., et al., "Electrohydrodynamic Ion Source Design for Mass Spectrometry: Ionization, Ion Optics and Desolvation," *Proceedings of the 38th ASMS Conference on Mass Spectrometry and Allied Topics*, Tucson, Arizona, Jun. 3-8, 1990.
Feng, X., et al., "Single Isolated Droplets with Net Charge as a Source of Ions," *J. Am. Soc. Mass Spectrom*, 11, pp. 393-399 (2000).
Schneider, B. B., et al., "An Atmospheric Pressure Ion Lens to Improve Electrospray Ionization at Low Solution Flow-Rates," *Rapid Commun. Mass Spectrom* 15, pp. 2168-2175 (2001).
Alousi, A., et al., "Improved Transport of Atmospheric Pressure Ions Into a Mass Spectrometer," *The Proceedings of the 50th ASMS Conference on Mass Spectrometry and Allied Topics*, Orlando Florida, Jun. 2-6, 2002.
Klesper, H., et al., "Intensity Increase in ESI MS by Means of Focusing the Spray Cloud onto the MS Orifice," *The Proceeding of the 50th ASMS Conference on Mass Spectrometry and Allied Topics*, Orlando, Florida, Jun. 2-6, 2002.
Schneider, B. B., et al., "An Atmospheric Pressure Ion Lens that Improves Nebulizer Assisted Electrospray Ion Sources," *J. Am. Soc. Mass Spectrom. 13*, pp. 906-913 (2002).
Hartley, F. T., et al., "NBC Detection in Air and Water," *Micro/Nano 8*, pp. 1, 2, and 8 (Dec. 2003).
Cody, R. B., et al., "Versatile New Ion Source for the Analysis of Materials in Open Air Under Ambient Conditions," *Anal. Chem. 77*, pp. 2297-2302 (2005).
McEwen, C. N., et al., "Analysis of Solids, Liquids, and Biological Tissues Using Solids Probe Introduction at Atmospheric Pressure . . . ," *Anal. Chem. 77*, pp. 7826-7831 (2005).
Niessen, W.M.A. and van der Greef, J., "Liquid Chromatography—Mass Spectrometry Principles and Applications," Marcel Dekker, Inc., New York, New York, pp. 339-341, Copyright 1992.
Hart, K. J., et al., "Reaction of Analyte Ions With Neutral Chemical Ionization Gas," *Journal of the American Society for Mass Spectrometry*, vol. 3, No. 5, pp. 549-557, 1992 (ISSN 1044-0305).
Bruins, A.P., "Mass Spectrometry With Ion Sources Operating at Atmospheric Pressure," *Mass Spectrometry Reviews*, vol. 10, pp. 53-77, 1991.
Duckworth, D. C., et al., "Radio Frequency Powered Glow Discharge Atomization/Ionization Source for Solids Mass Spectrometry," *Analytical Chemistry*, vol. 61, No. 17, pp. 1879-1886, Sep. 1, 1989.
Beres, S.A., et al., "A New Type of Argon Ionisation Detector," *Analyst*, vol. 112, pp. 91-95, Jan. 1987.
Lovelock, J.E. and Lipsky, S.R., "Electron Affinity Spectroscopy—A New Method for the Identification of Functional Groups in Chemical Compounds Separated by Gas Chromatography," *J. Amer. Chem. Soc.*, vol. 82, pp. 431-433, Jan. 20, 1960.
Lovelock, J.E., "A Sensitive Detector for Gas Chromatrography," *Journal of Chromatography*, vol. 1, pp. 35-46, 1958.
Lovelock, J.E., "Measurement of Low Vapour Concentrations by Collision with Excited Rare Gas Atoms," *Nature*, vol. 181, pp. 1460-1462, 1958.
"Principles of DC and RF Plasma Spraying" [online], 1 p., Retrieved from the Internet: http://wiv.vdi-bezirksverein.de/HenneVDI.pdf.
Leparoux, et al., "Investigation of Non-Oxide Nanoparticles by RF Induction Plasma Processing—Synthesis, Modelling and In-Situ Monitoring," *EMPA-Thun, Materials Technology*, 1 p.
Guimbaud, C., et al., "An APCI Ion Source to Monitor $HNO_3$ Under Ambient Air Conditions" [online], 1 p., Retrieved from the Internet: http://lch.web.psi.ch/pdf/anrepo3/19.pdf.
Cody, et al., "DART™: Direct Analysis in Real Time for Drugs, Explosives, Chemical Agents, and More . . . ," Sanibel Conference (American Society for Mass Spectrometry Sanibel Conference on Mass Spectrometry in Forensic Science and Counter-Terrorism), Clearwater, Florida, 39 pp., Jan. 28-Feb. 1, 2004.
Becker, K. H., et al., "Non-Equilibrium Air Plasmas at Atmospheric Pressure," Institute of Physics Publishing, Philadelphia, Pennsylvania, 42 pp., 2005 (Cover, Copyright Page, Table of Contents, and pp. 276-277, 286-293, and 328-350).

* cited by examiner

SOFT CHEMICAL IONIZATION SOURCE

BACKGROUND OF THE INVENTION

1. Field of the Invention

This invention relates generally to methods and systems for ionization of a sample. More specifically, this invention comprises methods and systems for generating reagent ions to interact with a sample to produce ions from the sample.

2. Description of the Related Art

There is a present and growing need to detect a wide variety of chemicals as solids, liquids and vapor, resident in air or solutions, or on surfaces. The potential analytes from these chemicals can include, for example, chemical warfare agents, pesticides, pollutants, drugs, explosives, and other chemicals under process control. Depending upon the chemicals, their physical properties, and the means of their dispersal, these chemicals can be present in air as vapor, aerosol or particulate matter; in water or solvents as solutions or emulsions; or on surfaces such as concrete, asphalt, paper or textiles. A common feature underlying most of these organic chemicals is that they can be ionized. Once a chemical is ionized, it can be detected by many different sensors.

Conventional sensors can exploit molecular charge, size, shape, or other specific characteristics to distinguish one ionized chemical from others and provide identification. A device, particularly if it were handheld, that could ionize chemicals as vapors, liquids or solids whether they be in air or other gases, in solutions, or on surfaces would, therefore, be desirable to extend the capabilities of many ion-dependent sensors. It would also be desirable if, as a consequence of ionization, the device did not fragment the chemical into an abundance of different ions, which can make detection and identification more difficult.

A very wide range of chemicals can be ionized using a two step process. First, reactant ions such as $O_2^-$ or $H^+(H_2O)_n$ are created. Upon contacting these ions, many chemicals are subsequently ionized, and these ions can then be detected. However, although conventional devices and methods attempt to accomplish positive ion chemical ionization at atmospheric pressure, there is a need for simple and reproducible means to perform atmospheric pressure chemical ionization using negative ions. Radioactive elements, such as $^{63}Ni$, can be used to ionize chemicals, particularly in handheld detectors. However, the owner or users of the device are burdened with logistical matters, such as licensing, reporting, and disposal requirements, involving the use of radioactive material. Non-radioactive ionization sources, such as gas discharge devices, eliminate such logistical concerns, but pose a different set of challenges. For example, power consumption and size may not be consistent with intended usage. It can be very difficult to control the discharge so that over long periods of usage only the desired ions are produced and the undesirable ions are not produced. Degradation of performance must be avoided from parts that wear out as a consequence of the discharge. Furthermore, there are many types of gas discharge devices, each having its own power and configuration requirements that can limit utility in a desired application. Finally, the need for helium or other bottled gas may render a particular device impractical for handheld, portable applications.

BRIEF SUMMARY OF THE INVENTION

A pin-to-plane discharge device in a chamber having air flowing through may produce mostly ions of little utility, such as $NO_2^-$, $NO_3^-$, and only some $O_2^-$. A soft chemical ionization source (SCIS) can significantly improve the amounts of reactant or reagent ions produced. Various embodiments of the SCIS do not incorporate chambers, but all include at least one needle made from tungsten or stainless steel rod. The operating conditions for the SCIS embodiments include maintaining a constant glow discharge at high voltage, low current. The SCIS produces a discharge having types of ions that can be optimized for ionization of samples. By adjusting the physical structures and applied voltages, the ion outputs of several of the devices in positive mode can be greater than 95% $(H^+)(H_2O)_{n=1-4}$. These ions are useful for the production of positive ions from samples. Furthermore, in negative ion mode, $O_2^-$ reactant ions can be formed and ions with little or no use in ionizing samples (e.g., $NO_2^-$, $NO_3^-$) can be substantially reduced.

The SCIS embodiments provide a different approach to the problem of generating reactant ions from prior art embodiments as described in, for example, U.S. Pat. No. 6,949,741, wherein the reactant ion $O_2^-$ is a minor constituent of the ion mix produced. In certain of the SCIS embodiments described herein, $O_3^-$ accounts for 35% to 70% of the total ions produced, representing a significant increase in the capability to ionize samples. In testing the SCIS embodiments with a differential mobility spectrometer, a mass spectrometer, and chemical samples including chemical warfare agents (CWAs), MES (methyl salicylate), DPM (di(propylene glycol) monomethyl ether), CEES (2-chloroethyl ethyl sulfide), DMMP (dimethyl methyl phosphonate), DIMP (diisopropyl Methylphosphonate), DEMP (diethyl methyl phosphonate), and solid explosives (e.g., dinitrotoluene), the tests demonstrated which ions the SCISs can generate and that the SCISs are effective in ionizing samples as vapor in air, as liquids on surfaces, and as solids, in both positive and negative modes.

A SCIS can be small, require low power, reliably produce different ions depending on the operating conditions and configuration, and produce ions that ionize many sample chemicals in different phases in air, or solutions, or on surfaces. It is desirable to have a SCIS that can ionize samples or analytes that are gases, liquids or solids and that can be in air or other gases, in solution or suspension or on solid supports or materials. It is also desirable to have a device that produces a sufficient quantity of ions from samples or analytes such that the ions can be detected by using laboratory or hand-held ion detectors. Further, it is desirable to be able to equally ionize samples or analytes having extremely low or largely different vapor pressures without the ionization device physically contacting the samples, analytes, or the surfaces upon which they reside. It is also desirable to provide an ionization method and device whereby either positive or negative, or positive and negative reactant or reagent ions are produced from air at or near atmospheric pressure. Further, it is desirable to provide an ionization device that simultaneously produces positive and negative ions from samples and analytes. It is also desirable to provide an ionization source that operates at atmospheric pressure in ambient or controlled composition air and that produces reagent ions, from such air, that can ionize samples and analytes. Additionally, it is desirable to use aerodynamic or ion optic means to control the reagent ion movement to the sample. Further, it is desirable to generate reagent ions and to control the clustering of such ions to maximize the amount of ions available to react with samples or analytes.

In one embodiment, an ionization source has a housing having a center post extending therefrom, a plurality of needles extending from the housing, and a counterelectrode ring extending around the housing. The plurality of needles extend substantially parallel to the center post. The number of needles has an effect on the shape and type of ions in the discharge. The center post is positioned substantially in the center of the plurality of needles. The plurality of needles are each coupled to an electrical supply. The center post and the plurality of needles extend through the counterelectrode ring. The plurality of needles, the center post (which can serve as a passive electrode when no voltage is applied to it), and the counterelectrode can all be insulated from each other. A first voltage can be applied to the plurality of needles to form a gas discharge. The counterelectrode ring can be coupled to an electrical supply and a second voltage can be applied to the counterelectrode ring. The center post may also be coupled to an electrical supply. A third voltage applied to the center post can shape the cloud of reagent or reactant ions produced by the gas discharge.

In another embodiment, a method for producing ions from a target comprises applying a first voltage to electrify a plurality of needles arranged in an array around a center post, wherein a counterelectrode extends around the plurality of insulated needles; and exposing the center post, the plurality of needles, and the counterelectrode to a gas. The electrified plurality of needles react with the gas to generate reagent or reactant ions, and the reagent or reactant ions cause ions to discharge from the target analyte.

In yet another embodiment, an ionization source assembly has a tube having a first end and a second end, wherein a gas comprising a sample flows into the first end of the tube. An ionization source is attached to the tube and has a center post extending therefrom. A plurality of needles extend from the ionization source in a direction substantially parallel to the center post, wherein the center post is positioned substantially in the center of the plurality of needles. The plurality of needles are coupled to an electrical supply. A counterelectrode ring extends around the ionization source. The center post and the plurality of needles extend through the counterelectrode ring. The counterelectrode ring can be coupled to an electrical supply and a second voltage can be applied to the counterelectrode ring. A first voltage applied to the plurality of needles forms a gas discharge. The center post, the plurality of needles, and the counterelectrode ring are positioned inside the tube and exposed to the gas comprising the sample entering the first end of the tube. The interaction of the reagent ions in the gas discharge and the sample produces ions that exit from the second end of the tube.

DETAILED DESCRIPTION

Figure 1:
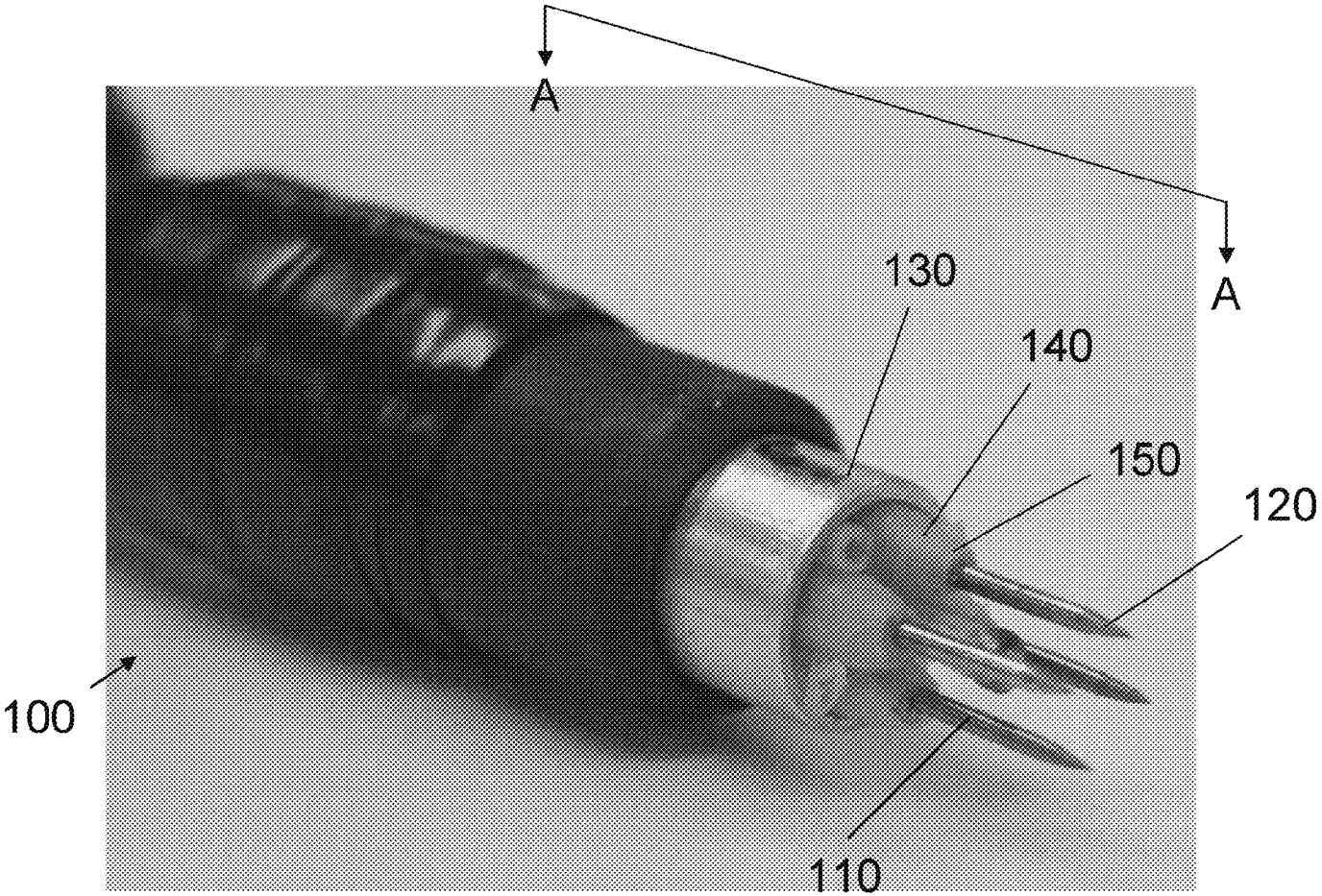
FIG. 1 shows a perspective view of a SCIS device according to an exemplary embodiment.

Reference will now be made in detail to the preferred embodiments of the present invention, examples of which are illustrated in the accompanying drawings.

A soft chemical ionization source (SCIS) includes several components. As described herein, a SCIS may be referred to as an ionization source, a SCIS device, or the SCIS may be incorporated in an ionization source assembly. An array of needles protrude from an end of the SCIS device. Each needle has a sharpened point at its distal end. Each needle also has an insulating material that electrically insulates the needle from other needles. This insulating material can be positioned away from the sharpened point. In the center of the array of needles is a center post having a shaped tip. This center post may be electrically floating or be attached to a source of voltage. The center post may not have any insulation, but is electrically insulated from the needles by the insulating material on each needle. The center post must also be insulated from the counterelectrode. The insulated needles and the center post are housed within a metal tube known as a counterelectrode. Electrical connectors are coupled to each needle and, if needed, to the center post, such that different voltages and currents (pulsed or unpulsed) can be applied to the needles, the center post, and the counterelectrode. The counterelectrode may extend to cover the needles, or an additional open tube may be added to cover the needles. Such coverings change the types, distributions, and amounts of ions formed in the gas discharge. Additionally, at least one ion optic lens can be used in front of the needles to focus and/or to accelerate ions generated in the needle region towards a sample or an analyte. Air or other gases can flow around the center post and needle array towards the tips of the needles. Additionally, air or other gases can be introduced beyond the tips of the needles. In an alternative embodiment, two or more of these SCIS devices can be assembled on one platform to increase the amount of reagent ions produced and to provide simultaneous streams of positive and negative reagent ions. Furthermore, the SCIS device can be located within a tube with sample air moving towards, perpendicular to, or away from the device.

The SCIS device has a flow of energy whereby the reagent ions produce mostly molecular ions from sample molecules. The production of these molecular ions may be advantageous because most of the sample molecules are converted to a single ion, rather than a multiplicity of ions, thereby maximizing sensitivity and lowering the minimum amount of a material that can be detected by a given sensor, i.e., the limit of detection. The SCIS device examines a sizable target area (on the order of at least one $cm^2$) that is representative of the volume of air, liquid, or solid surface being examined. The sample or analyte ions produced can be collected aerodynamically or with the aid of electric lenses that direct the ions to ion detection and identification means, such as an ion mobility spectrometer, a differential mobility spectrometer, or a mass spectrometer. Accordingly, the methods and devices described herein can perform positive ion, negative ion, or simultaneous positive ion and negative ion atmospheric pressure chemical ionization on sample chemicals in air, in liquids or on solids.

Referring to FIG. 1, a SCIS device 100 comprises a plurality of needles 110, each having a distal end 120. The distal end 120 can have a sharpened point or be slightly rounded. In an exemplary embodiment, a sharpened point on distal end 120 of needle 110 is sharpened at an angle greater than 10°, measured from the axis of the needle. The needle 110 can be constructed from a material that preferably will not pit or corrode with usage, such as tungsten or stainless steel. After the material is formed into the needle 110, it may be coated with platinum. As the diameter of the needle 110 increases, the ion output decreases. In one exemplary embodiment, the diameter of needle 110 is 0.04 inches. The needles 110 can have this exemplary diameter regardless of its length.

The needles 110 can be arranged in a variety of configurations within a counterelectrode 130 in the device 100. In the exemplary embodiment, the arrangement of needles 110 can be in a circular array or, when using four needles, along the corners of a square. In this exemplary embodiment, four needles 110 are used in the array, but any number of needles can be used. For example, in an alternative embodiment, seven needles are used. The needles 110 within the array can be spaced about 0.18 to 0.25 inches from each other. The needles 110 can be arranged substantially parallel to each other or flare out relative to each other. Additionally, the distal ends 120 of each needle 110 are preferably within the same plane. Small variations on each needle's location may have an effect on the types, distributions, and quantities of ions produced. The needles 110 are substantially enclosed by an insulating material 140 that may be directly applied and bonded to the needle 110. Alternatively, the insulating material 140 may be wrapped or fitted around the needle 110 such that the needle end opposite the distal end 120 is completely covered. The insulating material 140 may be made of Teflon tubing or other suitable insulating material. An end 150 of the insulating material 140 closest to the distal end 120 of the needle 110 can optionally be tapered. The needles 110 are exposed extending from the insulation material 140 to the distal ends 120 of the needles 110. In one example, a needle length of about 0.25 inches is bare from the insulation material 140 to the end of the needle 110. The needle 110 can be attached to a wire so that the needle 110 can be electrified. In one embodiment, the needle 110 is attached to a wire at the end opposite the distal end 120.

Figure 2:
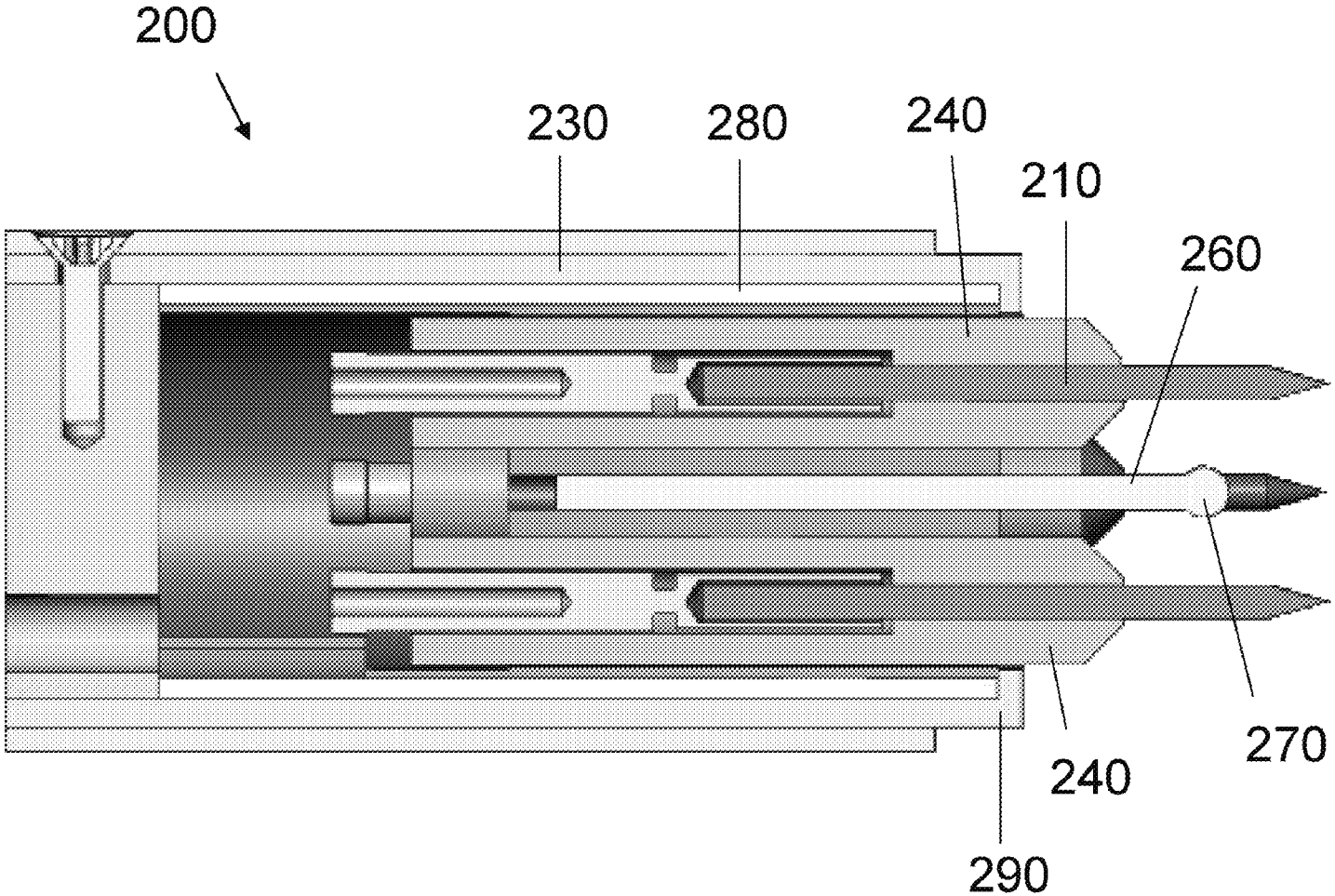
FIG. 2 shows a cross-sectional view of the device shown in FIG. 1 according to an exemplary embodiment.

FIG. 2 shows a cross-sectional view of the device in FIG. 1 through the line A-A. A device 200 has insulating material 240 with needles 210 extending therefrom. A center post 260 is positioned substantially in the center of the array of needles 210. The center post 260 can be made of the same material as the needles 210. An end 270 of the center post 260 is not sharpened; rather it is rounded into a hemisphere, ball, or tear-drop shape. Additionally, the center post 260 can have a diameter larger than the diameter of needles 210. For example, in one embodiment where the diameter of each needle 210 is 0.04 inches, the diameter of the center post 260 can be 0.125 inches. The center post 260 can be positioned equidistant from the needles 210. For example, the center post 260 can be about 0.125 inches from each needle 210. The end 270 of the center post 260 can be positioned such that it does not extend as far from the device 200 as the needles 210. In one embodiment, the end 270 of the center post 260 is set behind the end of the needles 210 by about 0.125 inches. The positioning of the center post 260 can be adjusted based on the plane defined by the ends of the needles 210. Unlike the needles 210 that are shielded by insulation material 240, the center post 260 has no need for insulation. However, the center post 260 can be covered with insulating material up to the bottom of the curved portion. The center post 260 can be coupled to a wire so that the center post 260 can be electrified if necessary. In one embodiment, the wire is coupled to the center post 260 at an end opposite the end 270. Removal of the center post 260 can eliminate the discharge between the needles 210 and the counterelectrode 230. Adjustment of position of the center post 260 can influence the shape and direction of the field around the center post 260 and needles 210.

The counterelectrode 230 can also influence the discharge. In an exemplary embodiment, the counterelectrode 230 is made of a metal tube. The counterelectrode 230 houses the array of insulated needles 210 and a center post 260. The counterelectrode 230 can have an insulating inner side 280 so that the needles 210 will not arc from the needle 210 to the inside of the counterelectrode 230. An end 290 of the counterelectrode 230 can be positioned in front of the needles 210, in the same plane as the ends of the needles 210, or behind the needles 210. In an alternative embodiment, instead of a tube configuration for the counterelectrode 230, a back plate can be used.

In an alternative embodiment, a separate tube can be positioned over the needles 210 to confine the discharged plasma. This separate tube can be connected to the counterelectrode 230 or it can be a removable tube that fits over the needles 210 and the counterelectrode 230. Positioning the tube over or beyond the needles 210 can significantly change the composition of reactant ions produced and the ions made from samples or analytes. In summary, by physically changing the spatial distances among the needles, the center post, and the counterelectrode, different reactant ions in a variety of distributions and quantities can be formed. Further, by changing the potentials applied to each of these three elements, the types, distributions, and quantities of reactant ions can be changed.

The same voltage amount can be applied to all needles 210. However, different voltages, continuous or pulsed, DC or AC, as square waves or other forms, can be applied to different needles 210 to achieve different reactant ion compositions. In one exemplary embodiment where a continuous DC voltage is applied, the voltage can be in the range of about 3 to 9 kV. Air flow can be in the range of about 0.0 to 8.0 L/minute. A significant "ion wind" may be produced when the device 200 is turned on in the absence of airflow. This ion wind can be sufficient to deliver ions to a surface, depending upon the application.

A gas can flow around the center post 260 and needles 210. In the exemplary embodiment, the gas is ambient air, though it is understood that any gas can be used. However, because ambient air is used, a source of another gas, such as a tank of helium, is not needed to produce the ions. The gas can be present in the environment in which the device 200 is being used. Alternatively, the device 200 can have one or more capillary tubes that can push or pull the gas through the device 200 to the region about the center post 260 and needles 210. These tubes or other types of pathways can be positioned between the center post 260 and the needles 210. The addition of a gas containing chemicals that can bind to, or react with, the ions formed by the discharge device can be beneficial in the detection of such ions by providing separation from similar species or from interferents.

Figure 3:
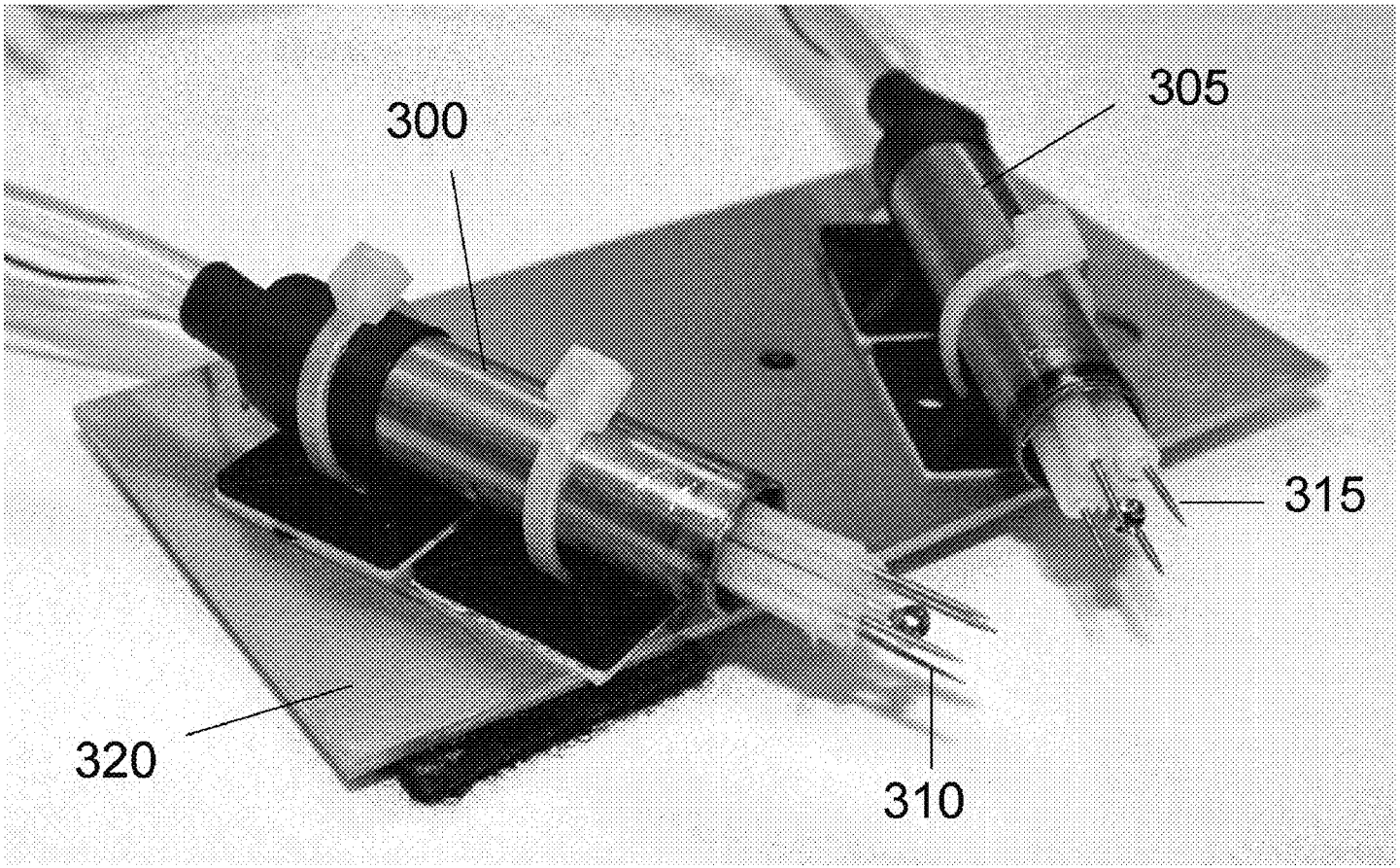
FIG. 3 shows a perspective view of a dual ionization source device according to an exemplary embodiment.

Different configurations of one or more SCIS devices can produce different results. Two or more SCIS devices can be positioned close to one another such that the amount of ions produced from the combination is greater than the aggregate amount of ions produced by those SCIS devices separately. Referring to FIG. 3, a dual SCIS device configuration is shown. In this configuration, a first reagent ionization source device 300 and a second reagent ionization source device 305 positioned on a platform 320 are directed at a sample (not shown) positioned beyond the end of the arrays of needles 310, 315. In an alternative embodiment, the first device 300 and the second device 305 can be in a parallel alignment. Each device 300, 305 can be run at the same potential and polarity or at different potentials and polarities. If different polarities are used for each device 300, 305, positive and negative ions can be produced simultaneously.

Figure 7A:
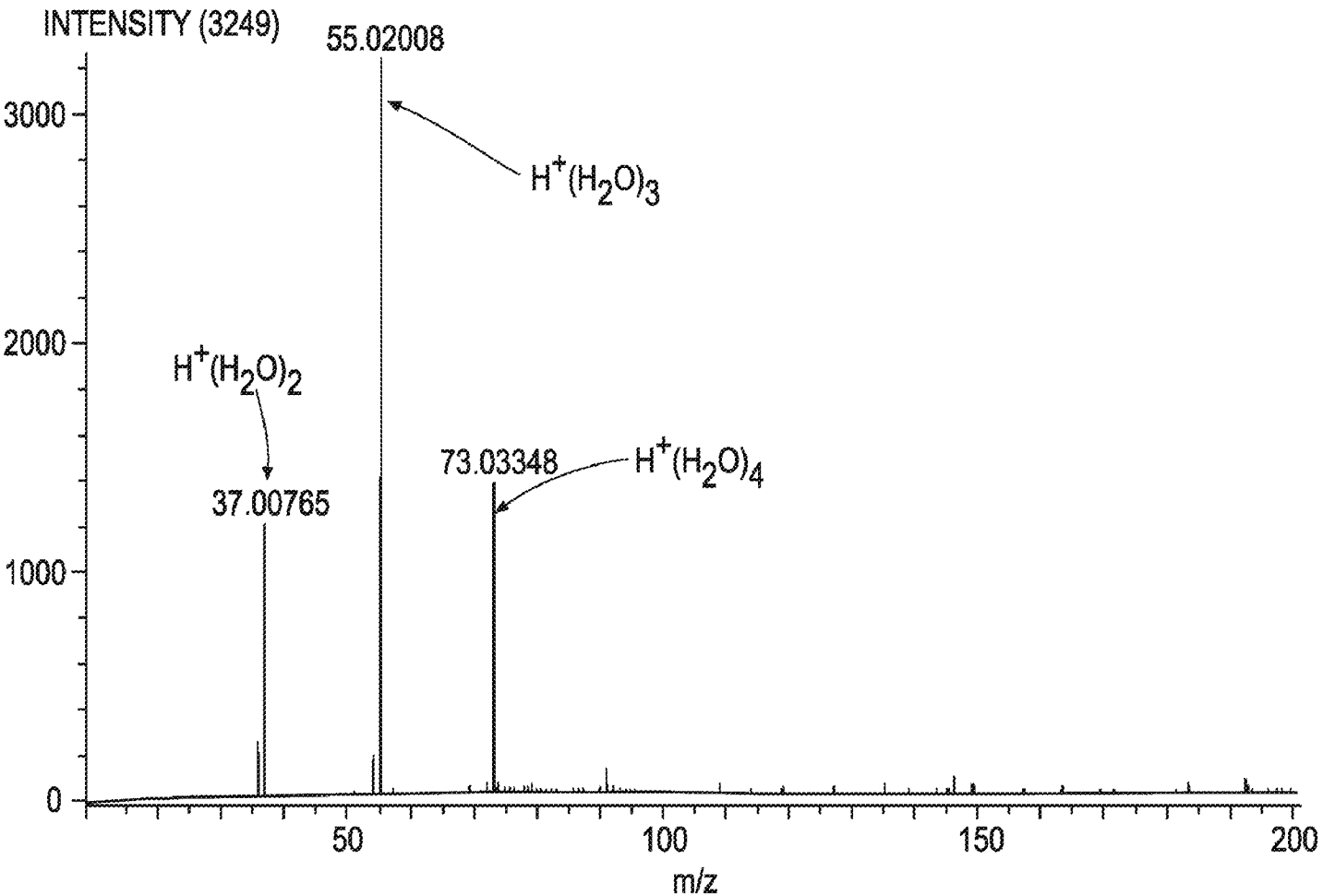
FIG. 7A shows positive ions produced by an ionization source configuration that provides a useful amount of energy to air surrounding the discharge according to an exemplary embodiment.
Figure 7B:
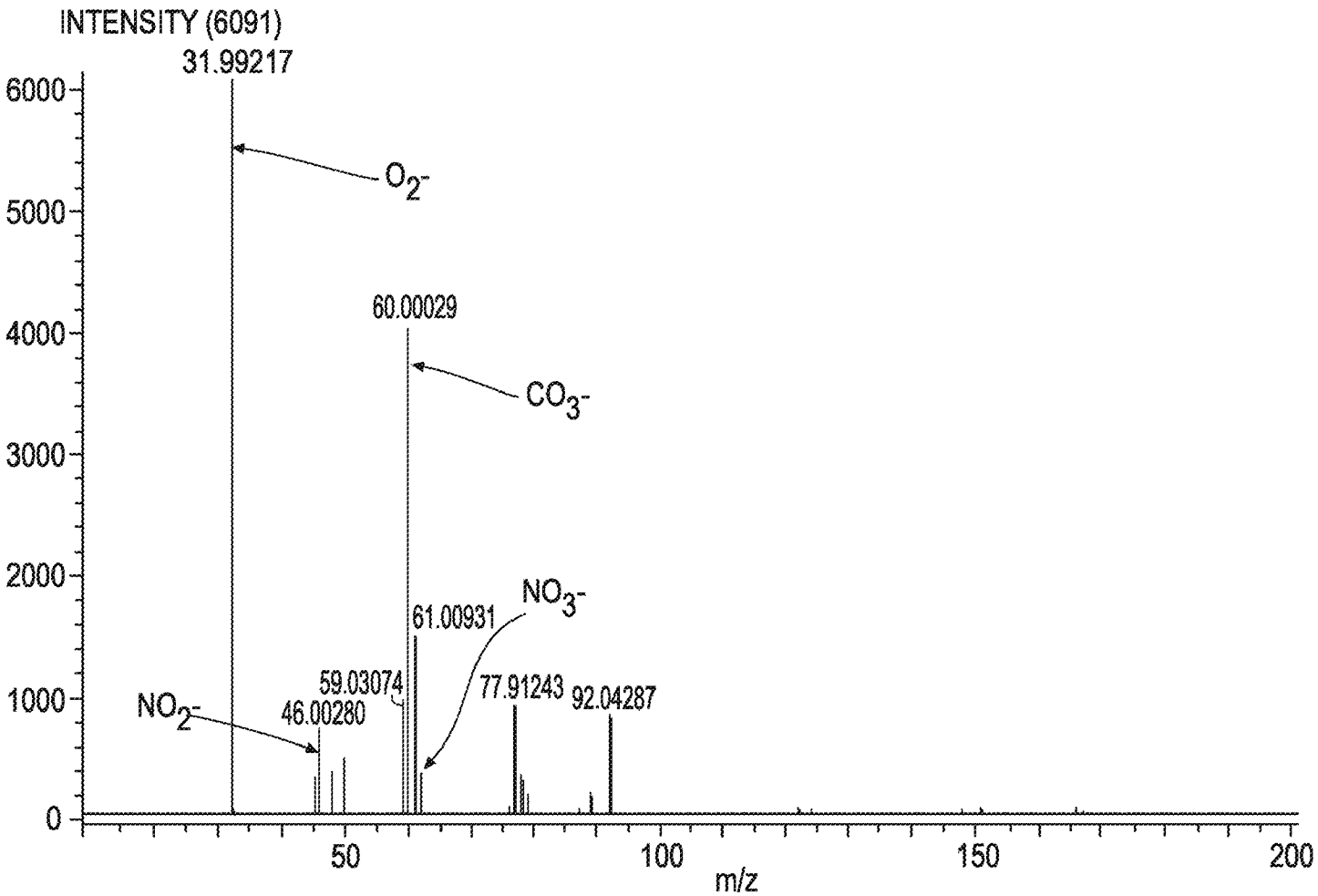
FIG. 7B shows negative ions produced by an ionization source configuration that provides a useful amount of energy to air surrounding the discharge according to an exemplary embodiment.
Figure 8A:
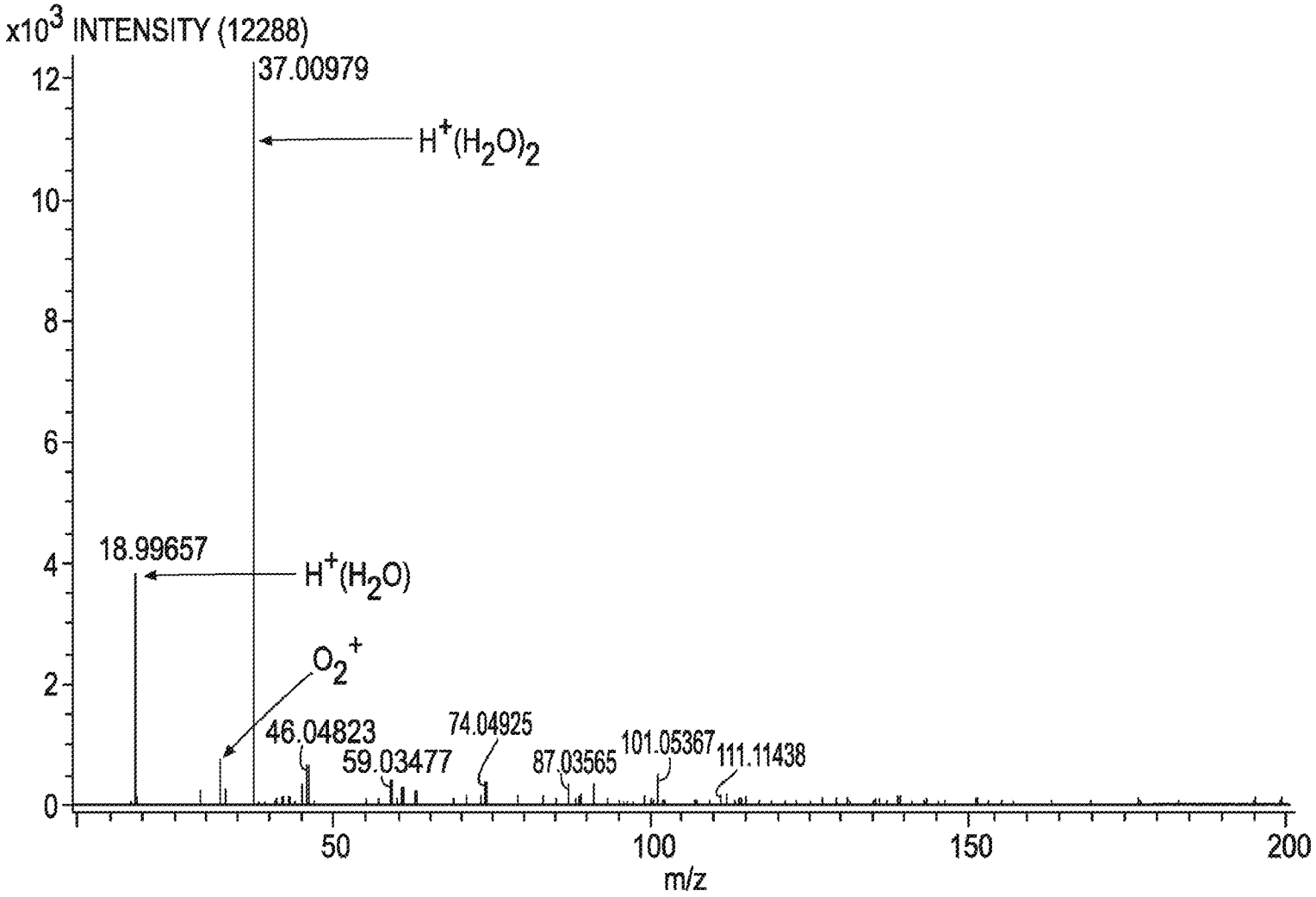
FIG. 8A shows positive ions produced by two ionization sources on the same platform according to an exemplary embodiment.
Figure 8B:
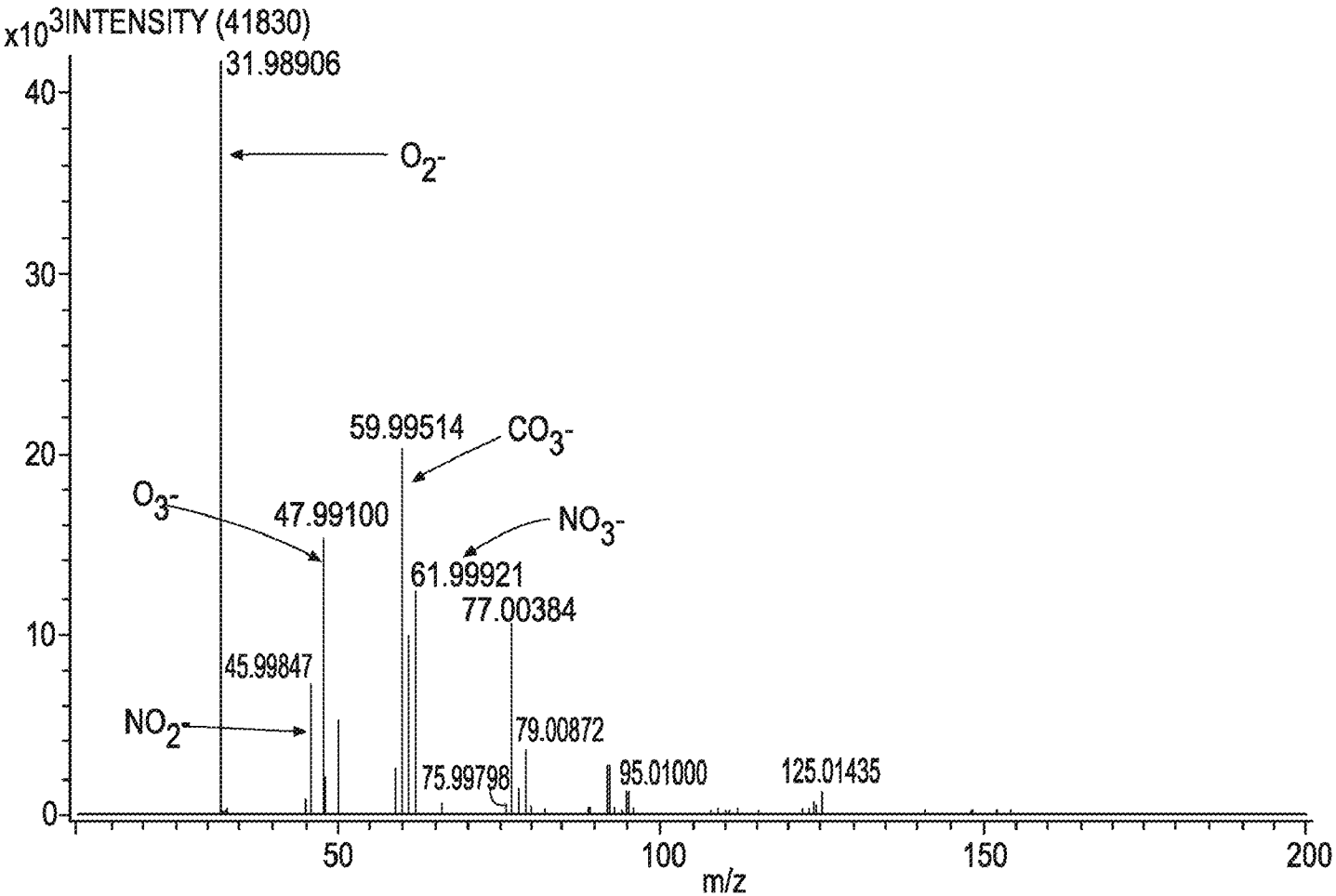
FIG. 8B shows negative ions produced by two ionization sources on the same platform according to an exemplary embodiment.
Figure 9A:
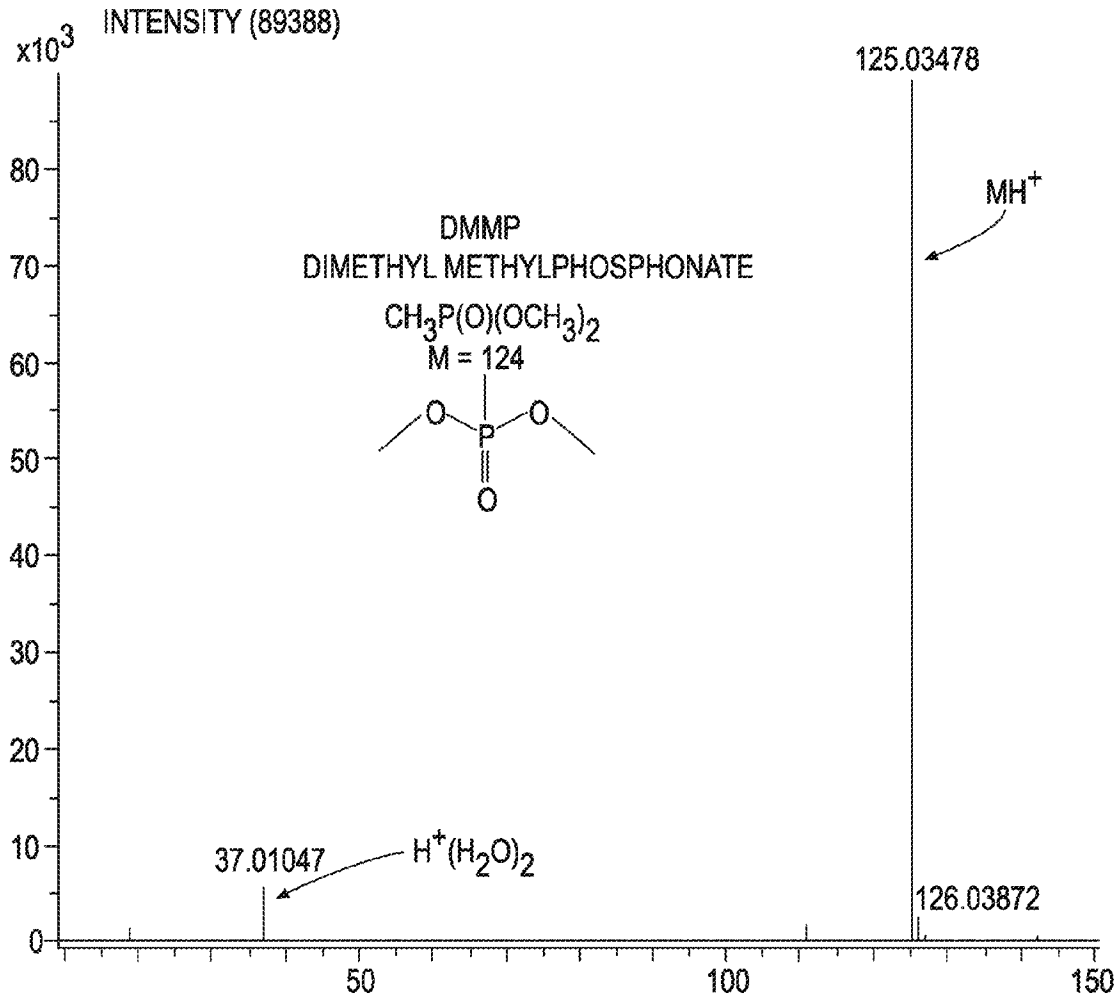
FIG. 9A shows DMMP (positive ions) obtained using two ionization sources on the same platform according to an exemplary embodiment.
Figure 9B:
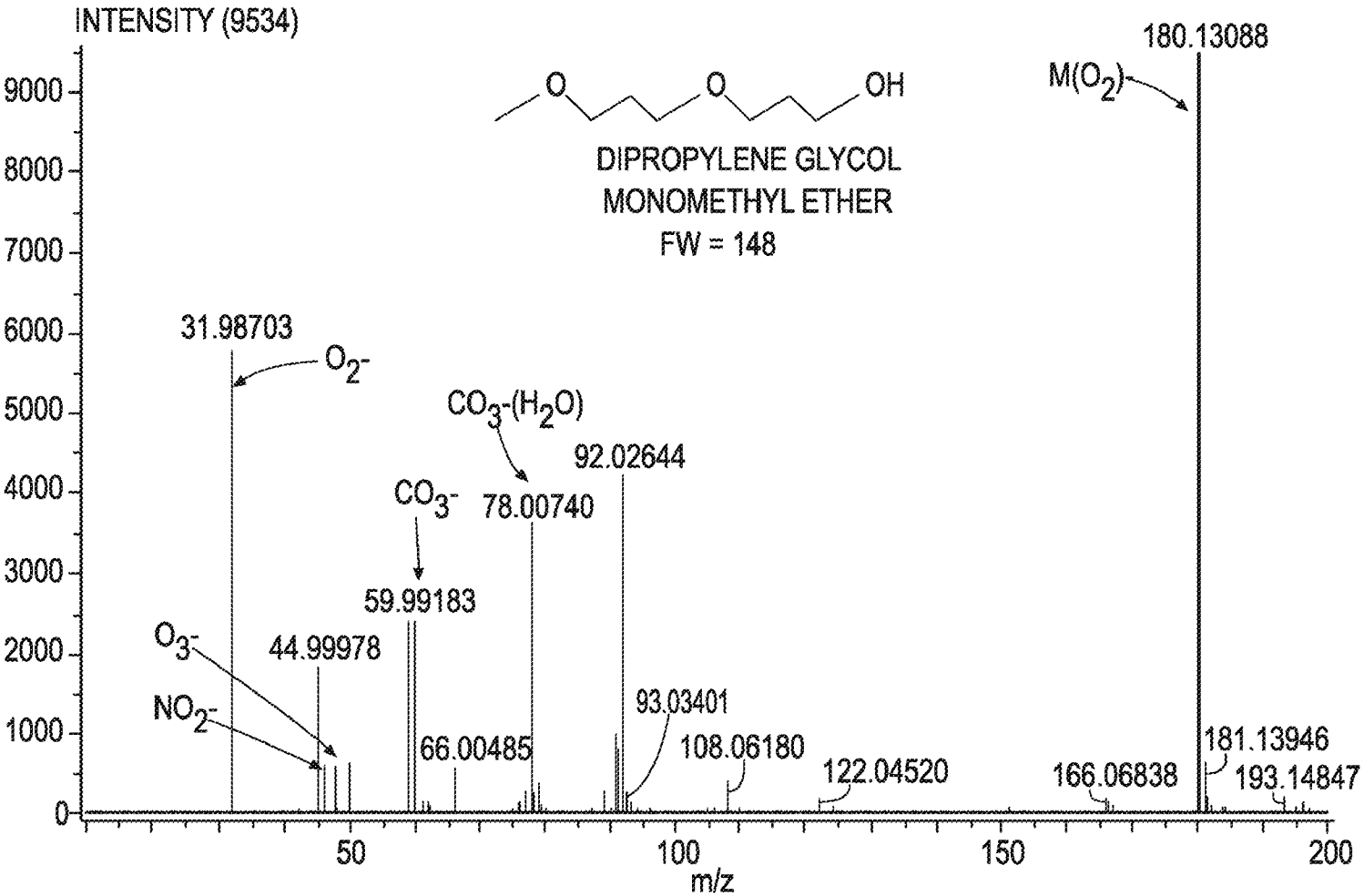
FIG. 9B shows DPM (negative ions) obtained using two ionization sources on the same platform according to an exemplary embodiment.
Figure 9C:
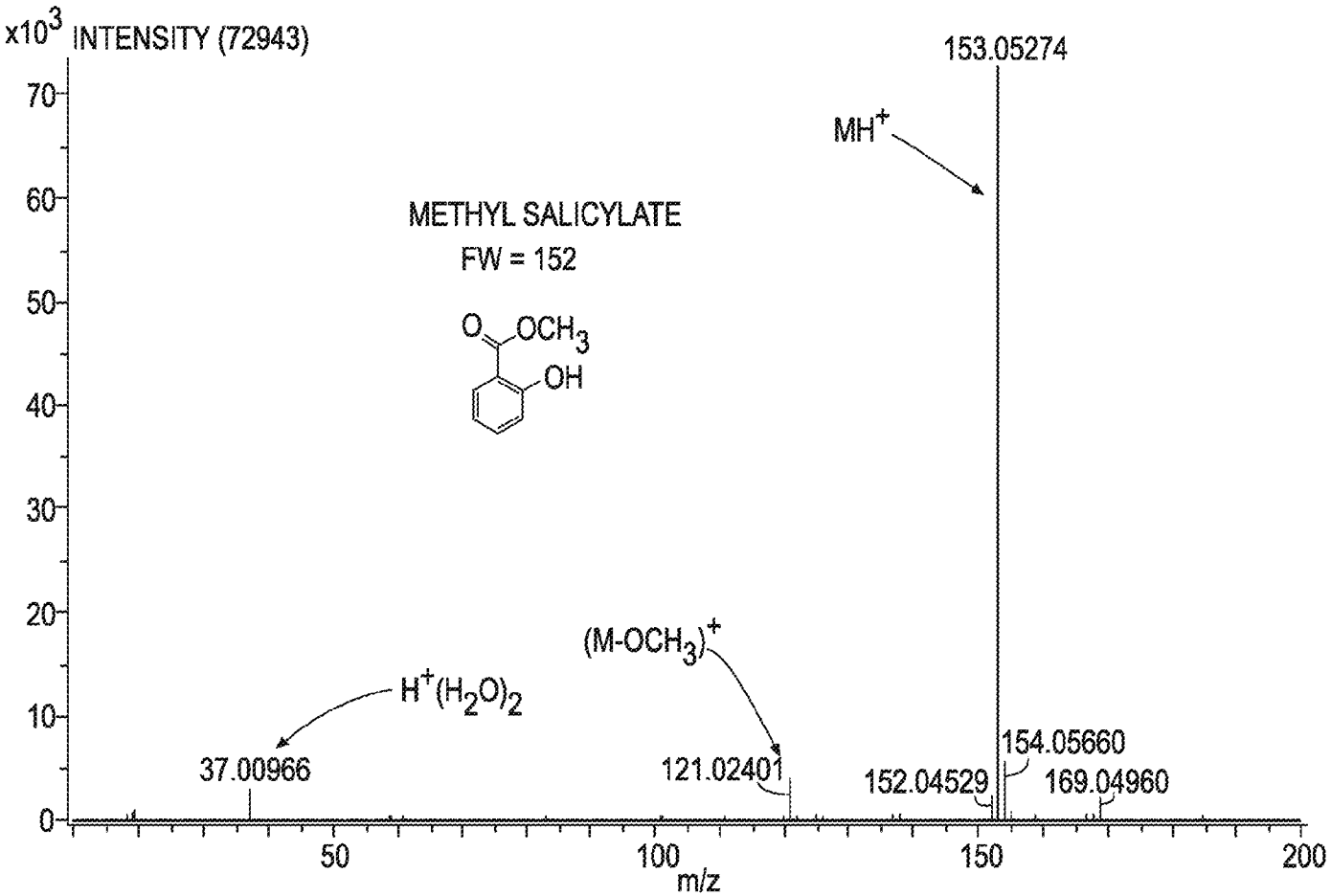
FIG. 9C shows MES (positive ions) obtained using two ionization sources on the same platform according to an exemplary embodiment.

In the exemplary configuration shown, each device 300, 305 can have opposite polarity. By positioning the devices in close proximity to each other, the ion distribution can be changed and the amount of ions produced can be increased at least four to six times. This configuration also produces more ions at less power. The configuration also results in a shift from ion clusters $H^+(H_2O)_{2-4}$ to $H^+(H_2O)_{1-2}$. This declustering can be useful because a positive ion is more likely to react with sample molecules if it is surrounded by less water molecules. This effect is shown in FIGS. 8A, 8B, 9A, 9B, and 9C, as compared to FIGS. 7A and 7B. FIGS. 7A and 7B show positive and negative ions, respectively, produced by a single ionization source first operated in positive mode, then in negative mode. FIGS. 8A and 8B show positive ions and negative ions, respectively, produced by two ionization sources on the same platform according to an exemplary embodiment. FIGS. 9A and 9B show DMMP (positive ions) and DPM (negative ions) obtained using two ionization sources on the same platform. FIG. 9C shows MES (positive ions) obtained using two ionization sources on the same platform. In contrast, FIGS. 7A and 7B show different positive ion and negative ion clusters and amounts than those shown in FIGS. 8A, 8B, 9A, 9B, and 9C.

Depending on operating conditions and placement of each of the two devices 300, 305 relative to each other, changing operating voltages can raise or lower all ions produced, or can increase one type of ion, while reducing the amount of other ions. For example, if the potential on a positive ionization source is zero, and the potential on a negative ionization source is varied from −3.2 kV to −7.8 kV, then an ion peak at 32 amu ($O_2$) and the ion peak at 60 amu ($CO_3^-$) both decrease linearly as the potential changes from −3.2 kV to −7.8 kV. However, if the potential on the positive ionization source is fixed at 6.0 kV and the potential on the negative ionization source is varied from −4.5 kV to −7.8 kV, then an ion peak at 32 amu increases by about twice the amount, while an ion peak at 60 amu is reduced by about three times the amount. These relationships among potentials and ion production allow the selection of operating conditions wherein one type of ion is produced in much greater quantities than another type of ion. Specifically, with the positive ionization source set at 3.2 kV and the negative ionization source set at −7.8 kV, a negative ion peak at 32 amu is three times larger than all other ion peaks combined and six times larger than the ion peak at 60 amu. There are only traces of $O_3^-$, $NO_2^-$, and $NO_3^-$ (combined=5% of the $O_2^-$ peak). When the positive ionization source is set at a potential of 6.4 kV, and the negative ionization source is set at a potential of −3.7 kV, 19% and 62% of the total ion count are at 19 amu ($H^+(H_2O)$) and 37 amu ($H^+(H_2O)_2$), respectively.

Without any ion focusing, each ionization source can act like a point source in that it produces a three dimensional cloud or field of ions that reaches in front of, around, and behind the needles. Hence, there is little degradation in the number of ions produced and, as the ionization source is moved relative to a target, there is little difficulty in ions reaching the target. Also, this means that the ion source can be either perpendicular or parallel to the sample or surface upon which the sample resides and still produce sample ions. If the two ionization sources have opposite polarities, then the positive ions predominate on one side, the negative ions predominate on the other side, and a volume around the center line has both types of ions. In an alternative embodiment, an ion optic lens can be used to focus the ions.

Figure 4:
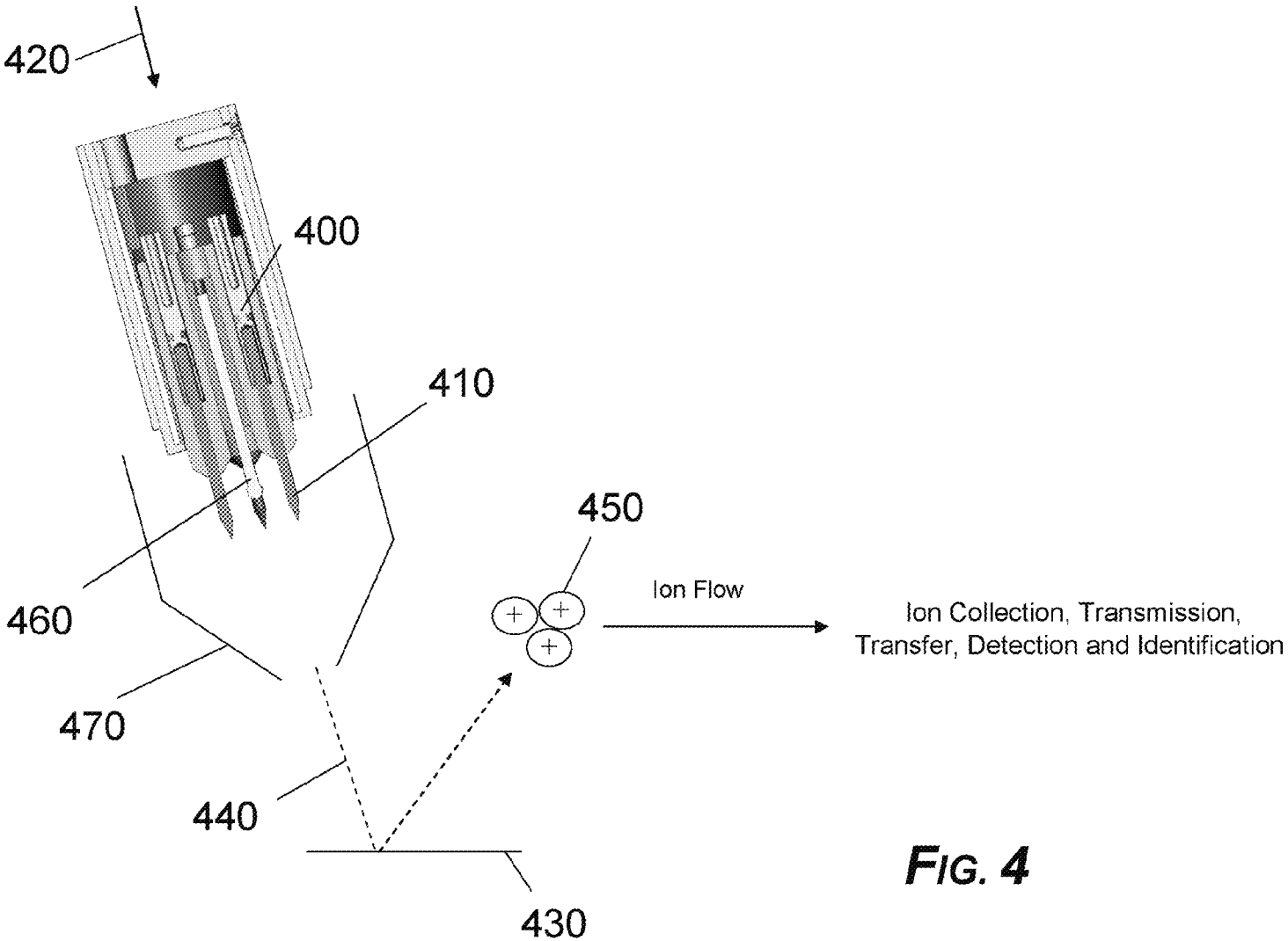
FIG. 4 shows how an ionization source ionizes samples that are subsequently detected according to an exemplary embodiment.

Referring to FIG. 4, a schematic view of how an ionization source ionizes samples that are subsequently detected is shown. Ambient air 420 can flow around a center post 460 and needle array 410 of an SCIS device 400 towards a target sample surface 430. The center post 460 and needle array 410 of the SCIS device 400 ionize the ambient air 420 to produce reagent ions 440 in the vicinity of the target sample surface 430. The reagent ions can be present in the vicinity of the center post 460 and needles 410, whereby this field is directed to interact with the sample surface 430. In one exemplary embodiment, the field is a spherical region centered about the center post 460 having a diameter of about four inches. The reagent ions 440 interact with the un-ionized chemicals or gas at the target sample surface 430 to discharge sample ions 450. The flow of ambient air 420 around the center post 460 is not necessary for the production of ions. Ambient air 420 around the needle array 410 is usually sufficient for ion production. The discharged ions 450 can be directed to ion collection, transmission, transfer, detection, and/or identification means. Optionally, an ion optic lens 470 can be used to focus and/or to accelerate ions generated in the needle region towards the sample surface 430.

In this exemplary embodiment, positive ions are shown, though it is recognized that a similar process is used for negative ions. The SCIS device can be used to produce both positive and negative ions, as well as mainly positive ions or mainly negative ions. In one embodiment, the SCIS device can produce more than 90% positive ions. In another embodiment, the SCIS device can produce more than 90% negative ions. Also, although ambient air is used in this exemplary embodiment, other types of reagent gases can be used.

Figure 5:
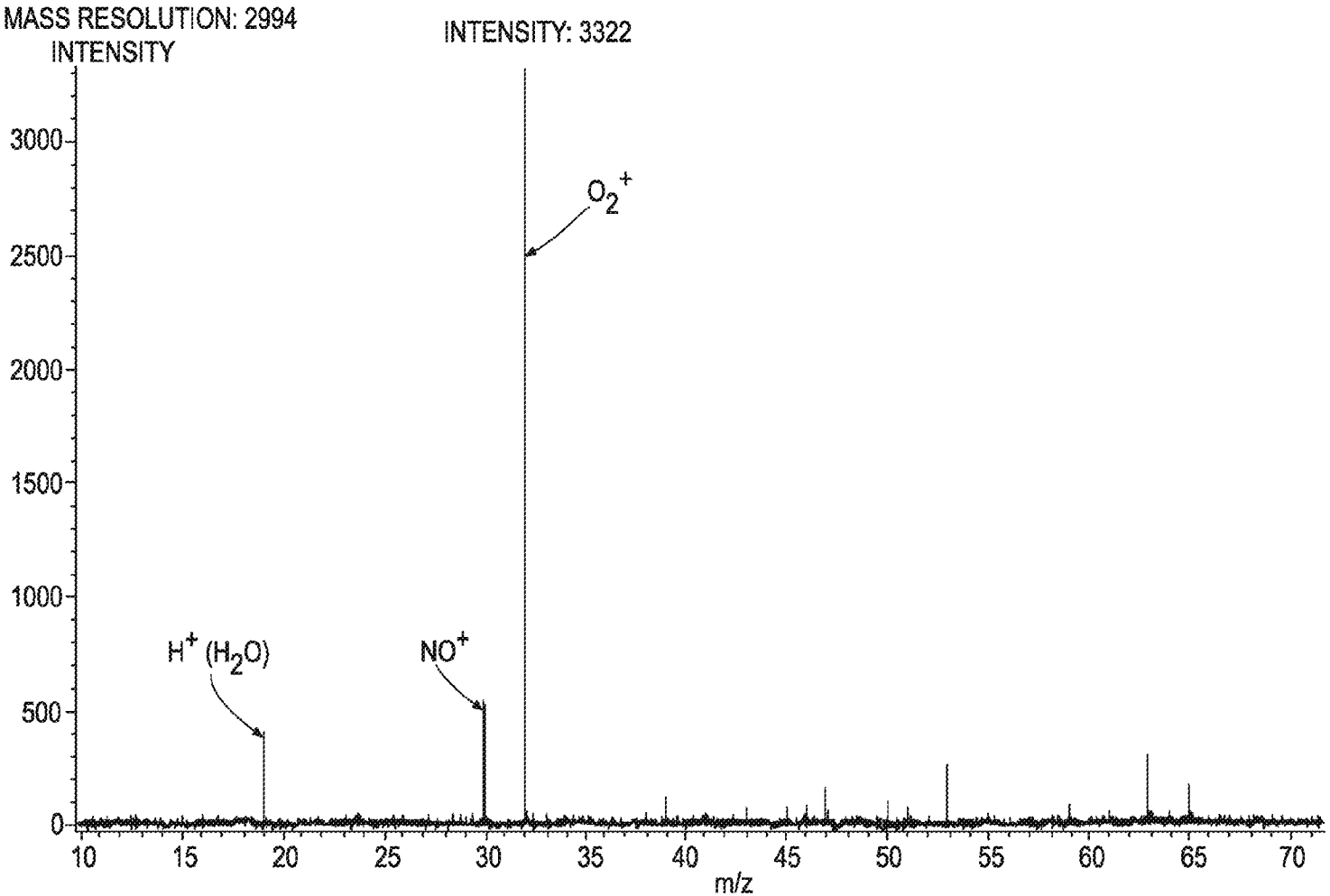
FIG. 5 shows positive ions produced by the ionization source at a high energy according to an exemplary embodiment.
Figure 6A:
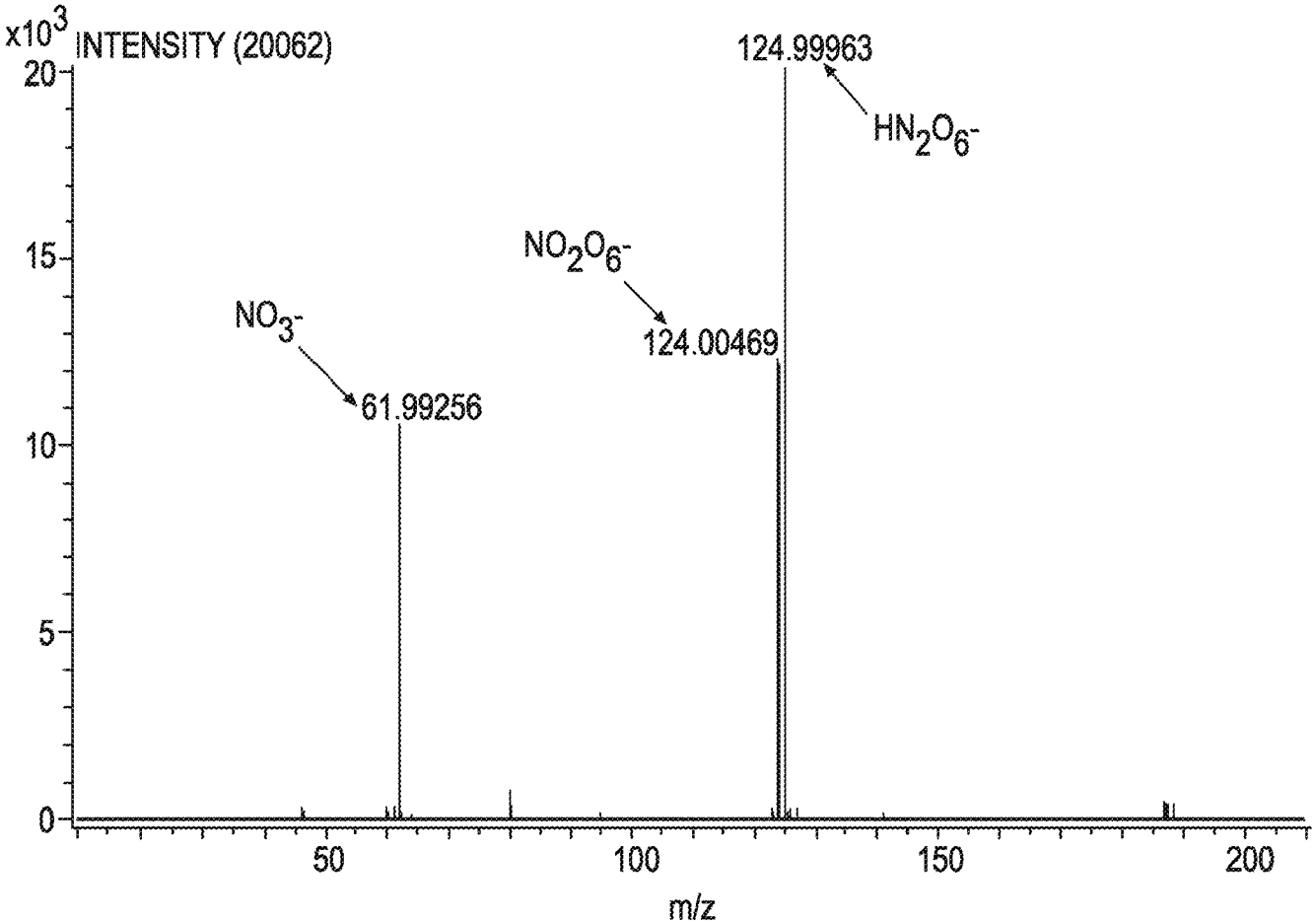
FIG. 6A shows negative ions produced by an ionization source configuration that provides significant amounts of energy to air surrounding the discharge according to an exemplary embodiment.
Figure 6B:
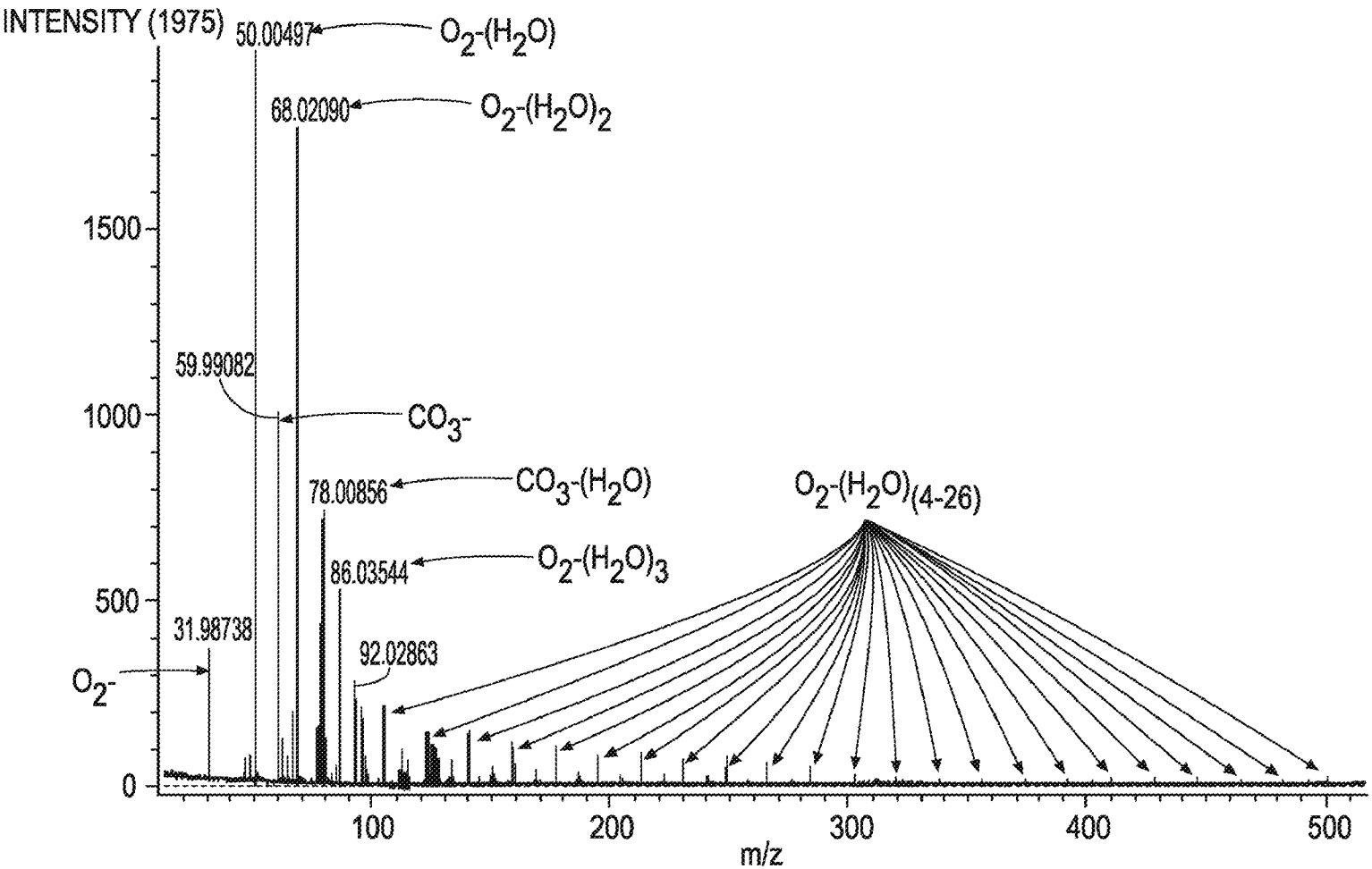
FIG. 6B shows negative ions produced by another ionization source configuration that provides significant amounts of energy to air surrounding the discharge according to an exemplary embodiment.

Various SCISs can produce different results. In FIGS. 5, 6A, 6B, 7A, and 7B, SCISs produced ions that were detected by a time-of-flight (TOF) mass spectrometer and the spectra are plotted as intensity versus mass-to-charge ratio (m/z). FIGS. 5, 6A, and 6B show spectra obtained by placing a tube or sheath over the needles. FIG. 5 shows positive ions produced by the ionization source at a high energy. FIGS. 6A and 6B show negative ions produced by an ionization source configuration that provides significant amounts of energy to air surrounding the discharge. Confining the discharge leads to the formation of ions requiring more energy to produce. Furthermore, the reactant ions in FIG. 6B form a continuum of increasingly hydrated species, producing clutter in the detector and reducing the amount of available reactant ions. FIGS. 7A and 7B show positive ions and negative ions, respectively, produced by an ionization source configuration, not having a sheath or tube over the needles, that provides an amount of energy to air surrounding the discharge to create enough ions without using a lot of power.

While ambient air is preferably used as a gas, selectivity can be achieved by using a different gas that has a different ionization potential. For example, other gases include, but are not limited to, helium, ammonia (10.2 eV), acetone (9.7 eV), and di n-propylamine (7.8 eV). Reactant ions from each of these gases would ionize chemicals having ionization potentials less than that of the respective gas. Accordingly, selectivity can be based on ionization potential. Furthermore, the ions in the gas can combine with the sample or analyte ions to produce ion/molecular clusters that can aid in analyte ion identification and separation.

Figure 11A:
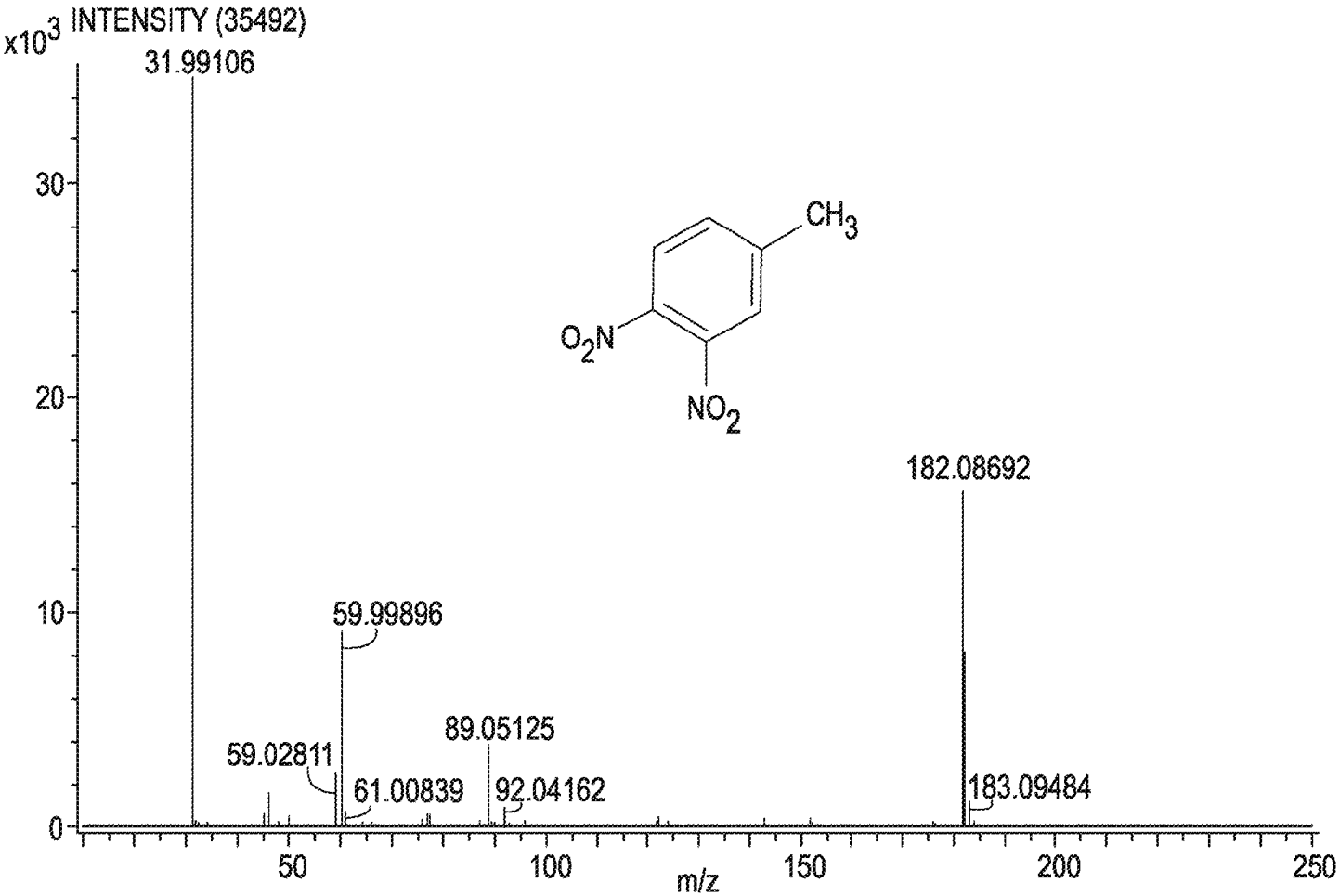
FIG. 11A shows a negative ion mass spectrum of ions created by reagent ions from an SCIS device directed onto solid 3,4 dinitrotoluene (FW=182) according to an exemplary embodiment.
Figure 11B:
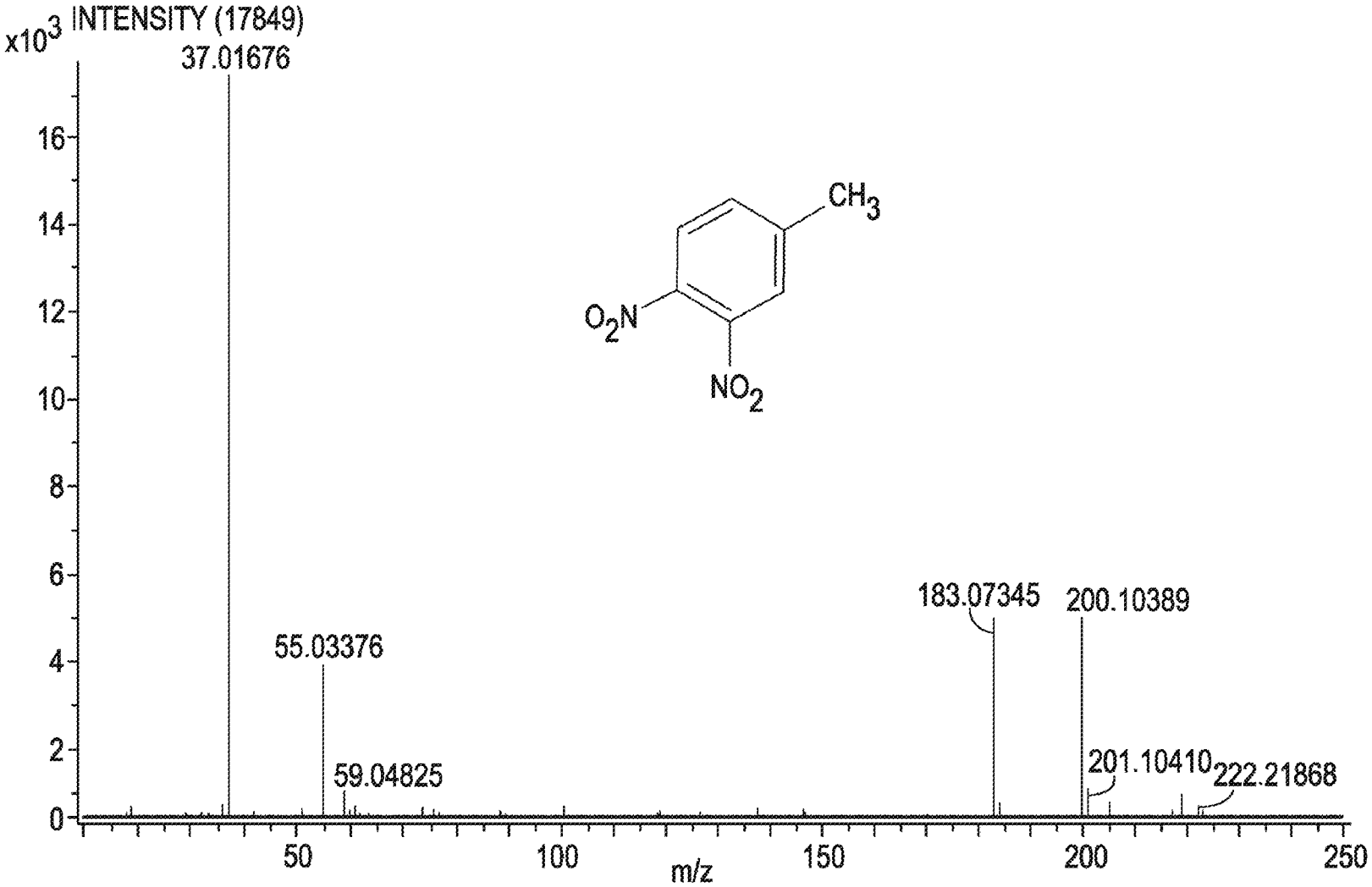
FIG. 11B shows a positive ion mass spectrum of ions created by reagent ions from an SCIS device directed onto solid 3,4 dinitrotoluene according to an exemplary embodiment.

Either single or multiple SCISs can be used to directly generate ions from gases, liquids, or chemicals on solids. As described above, FIGS. 9A and 9B show DMMP (positive ions) and DPM (negative ions) obtained using two ionization sources on the same platform, and FIG. 9C shows MES (positive ions) obtained using two ionization sources on the same platform. FIGS. 11A and 11B show a negative ion mass spectrum and a positive ion mass spectrum, respectively, of ions created by reagent ions from an SCIS device directed onto solid 3,4 dinitrotoluene.

Figure 10A:
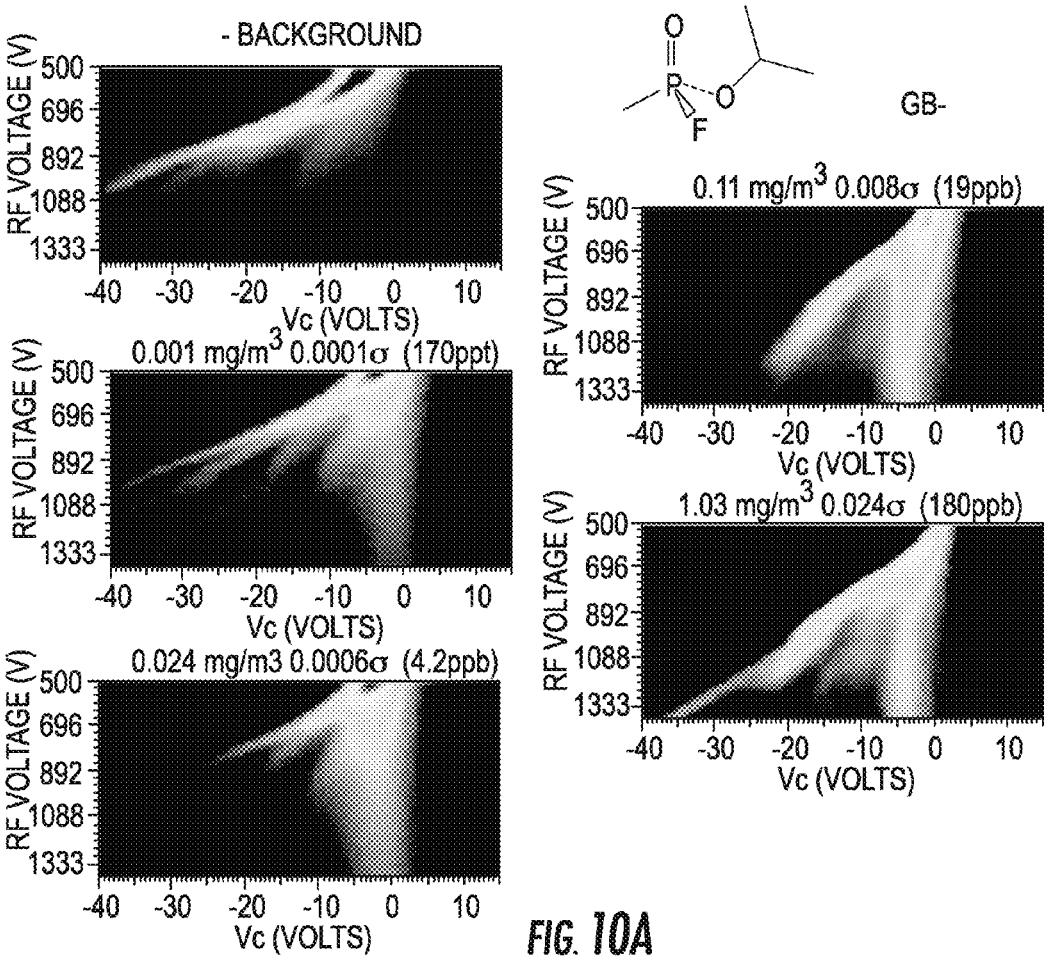
FIG. 10A shows the presence of negative ions generated from GB gas in various concentrations according to an exemplary embodiment.
Figure 10B:
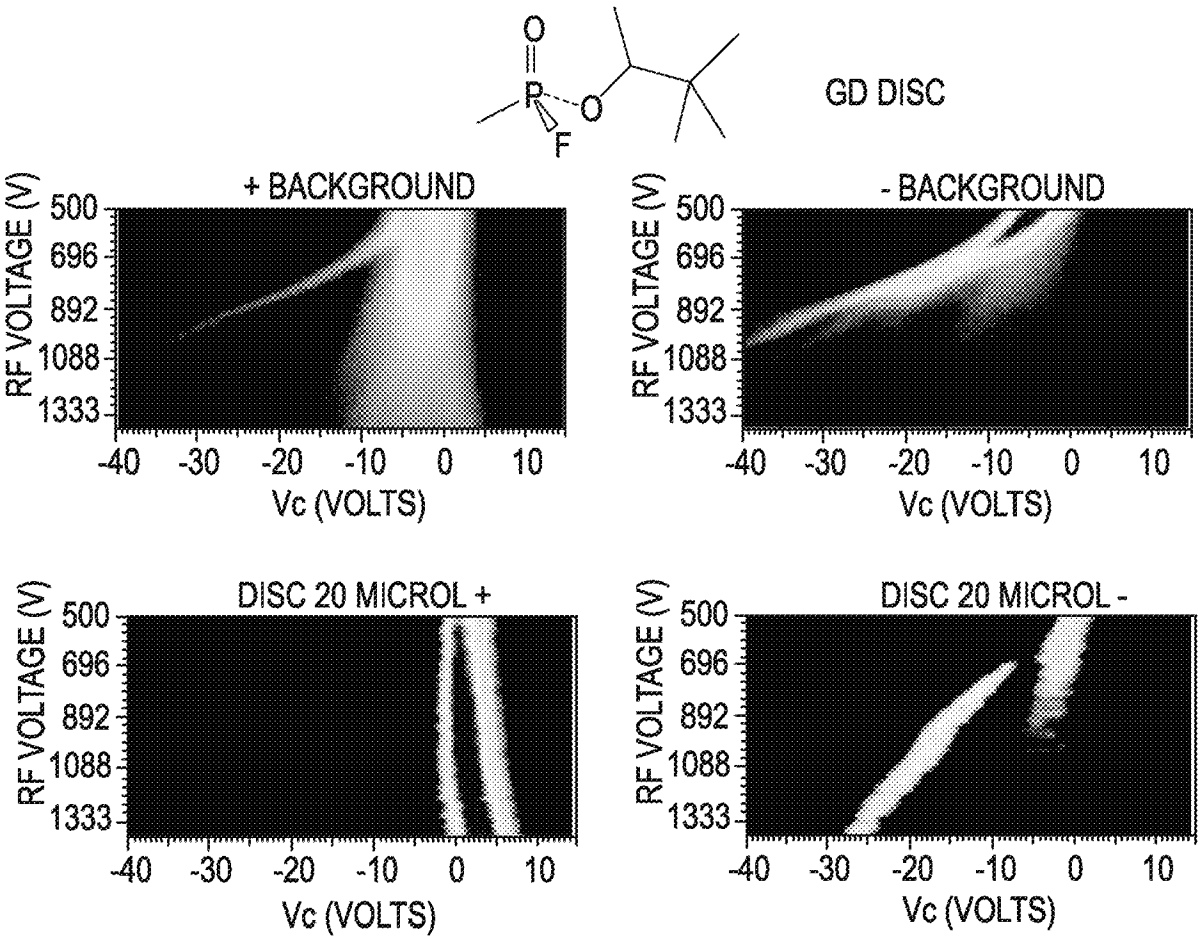
FIG. 10B shows the presence of positive and negative ions generated from a GD liquid drop on an inert disc according to an exemplary embodiment.
Figure 10C:
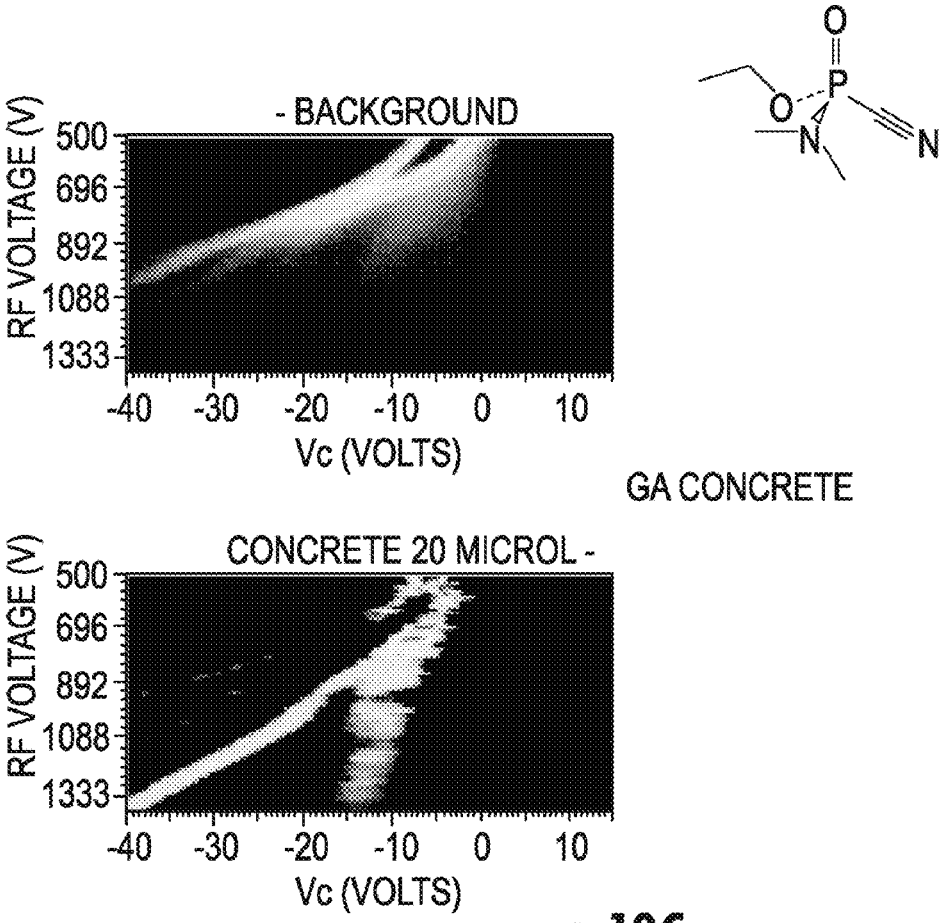
FIG. 10C shows negative ions generated from a GA liquid drop absorbed into concrete according to an exemplary embodiment.

These ions can be subsequently detected using ion detection/identification means, such as a microDMX differential mobility spectrometer made by Sionex Corporation. Referring to FIGS. 10A to 10C, subsequent detection by this spectrometer is shown. FIG. 10A shows the presence of negative ions generated from GB gas (sarin) in various concentrations, ranging from 170 parts per trillion to 180 parts per billion, FIG. 10B shows the presence of positive and negative ions generated from GD (soman) on a inert disc, and FIG. 10C shows negative ions generated from GA (tabun) absorbed into concrete. Accordingly, the SCIS device can be used in detecting, for example, parts per trillion of chemical warfare agents (CWAs) in the form of vapor; liquid CWAs on plastic surfaces, solid porous concrete, and other surfaces; and solid explosives.

Figure 12A:
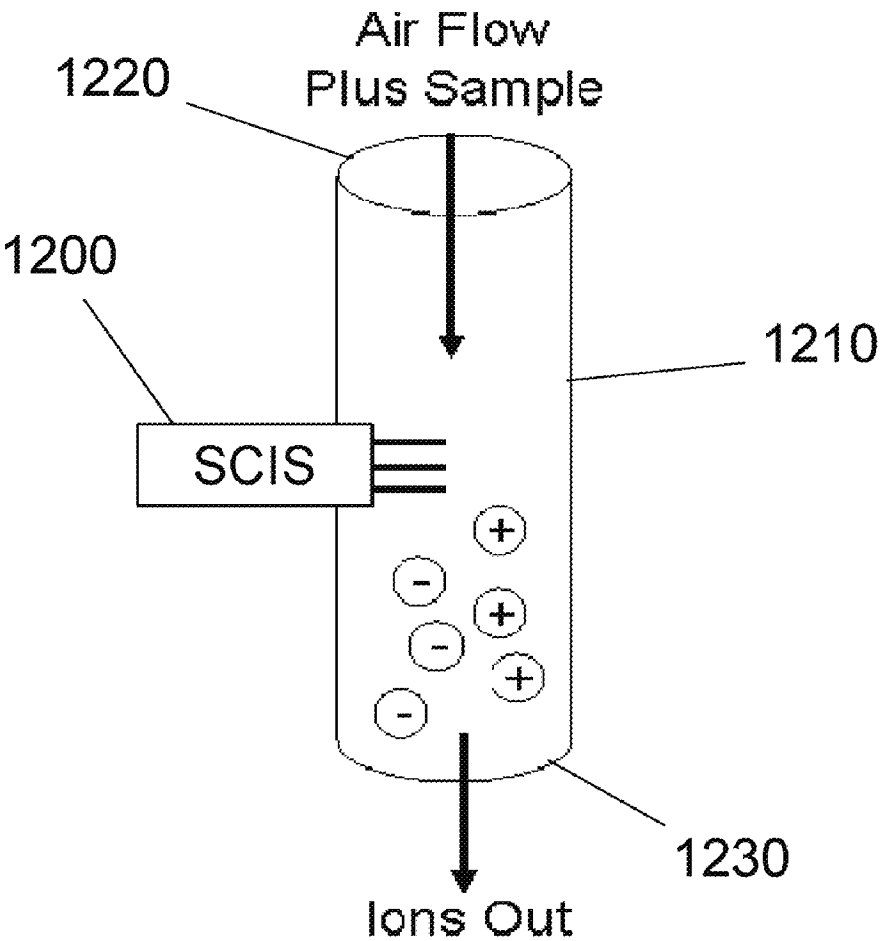
FIGS. 12A and 12B show an ionization source mounted in tubes for ionization of gaseous and/or aerosol samples according to an exemplary embodiment.

The SCIS may also be used within a wide tube to produce ions from a gas stream. FIG. 12A shows an ionization source mounted in tubes for ionization of gaseous and/or aerosol samples. A SCIS 1200 is mounted in a tube 1210 having air flow plus a sample into a first end 1220 of the tube 1210. Accordingly, ions exit the tube 1210 at a second end 1230.

Figure 12B:
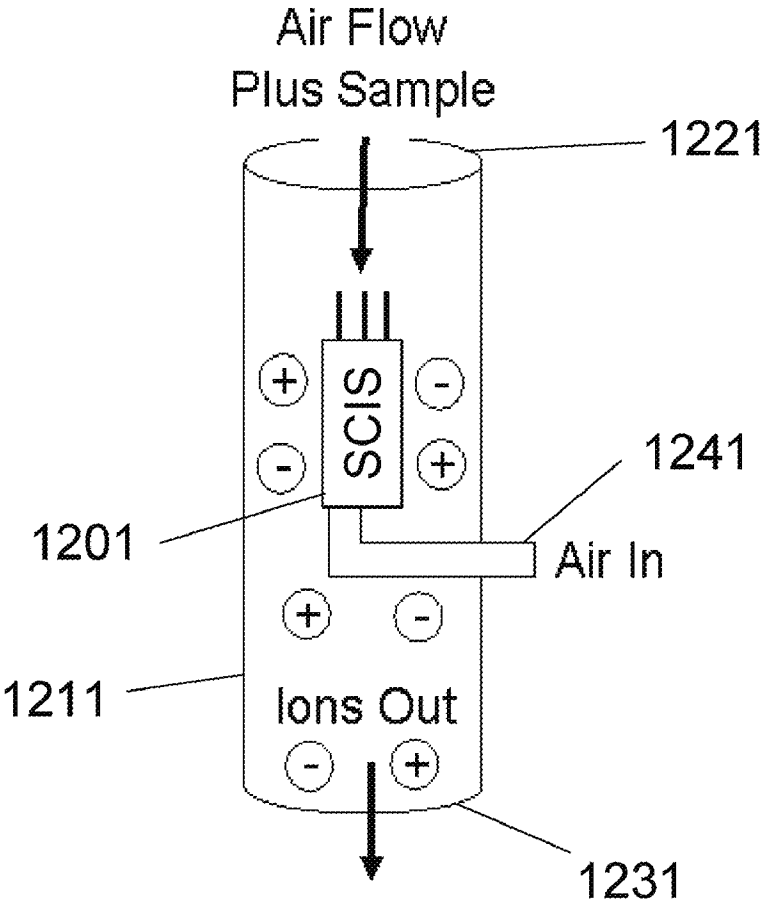

FIG. 12B shows an ionization source mounted in tubes for ionization of gaseous and/or aerosol samples, according to an alternative embodiment. A SCIS 1201 is mounted in a tube 1211. Air flow plus a sample enters the tube 1211 at a first end 1221. A passageway 1241 can be used to provide air of a different composition than that of the air flow in the first end 1221. For example, a dopant or other chemical that binds to, or reacts with the sample molecules can be added this way in order to modify the properties of the sample ions for detection. The generated ions exit the tube 1211 at a second end 1231.

Figure 12C:
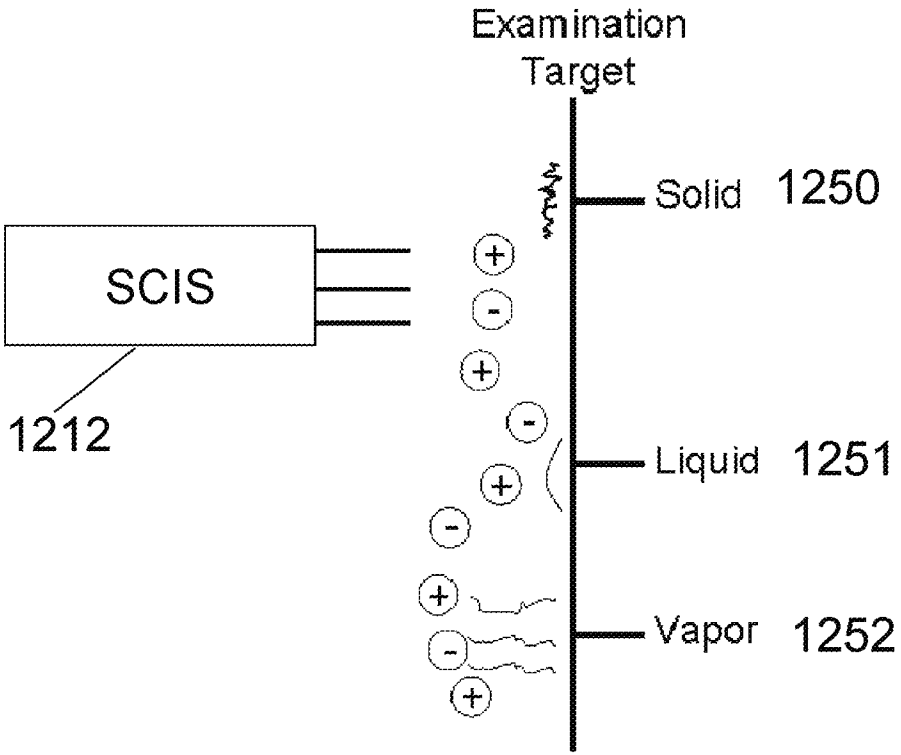
FIG. 12C shows a SCIS creating ions from solid, liquid, or vapor samples according to an exemplary embodiment.

FIG. 12C shows a SCIS 1212 for creating ions from a solid examination target 1250, a liquid examination target 1251, or a vapor examination target 1252.

Figure 13:
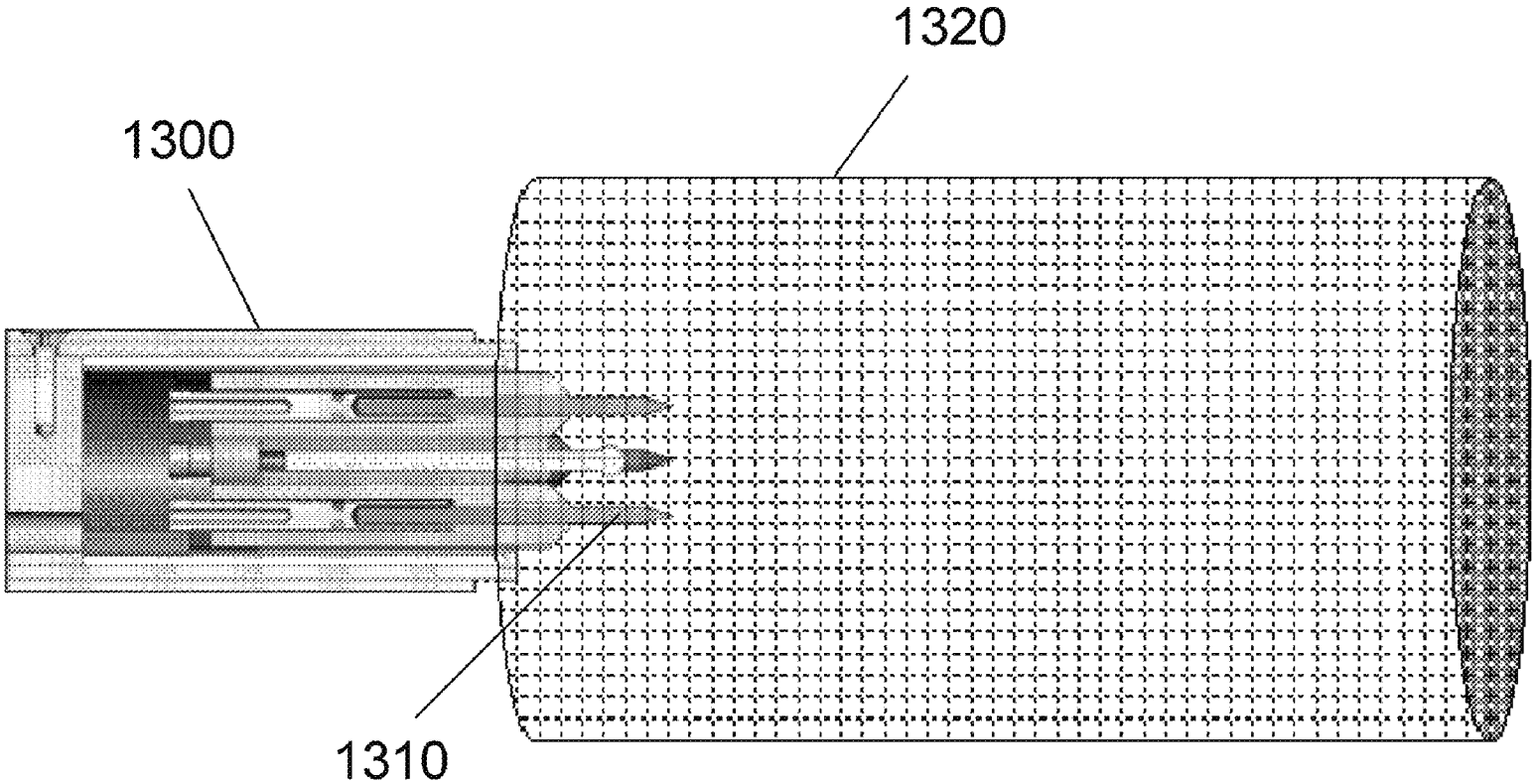
FIG. 13 shows an SCIS with an electrified mesh screen according to an exemplary embodiment.

In an alternative embodiment, referring to FIG. 13, a wire mesh screen 1320 can be used with a SCIS device 1300. The screen is positioned around an array of needles 1310 and projects forward past the needles 1310. When the screen 1320 is electrified with a voltage of opposite polarity to the ions produced by the SCIS device 1300, the screen 1320 can enhance the amount of ions detected at about one inch from the end of the screen by about 25% relative to the same configuration without the screen 1320.

Figure 14A:
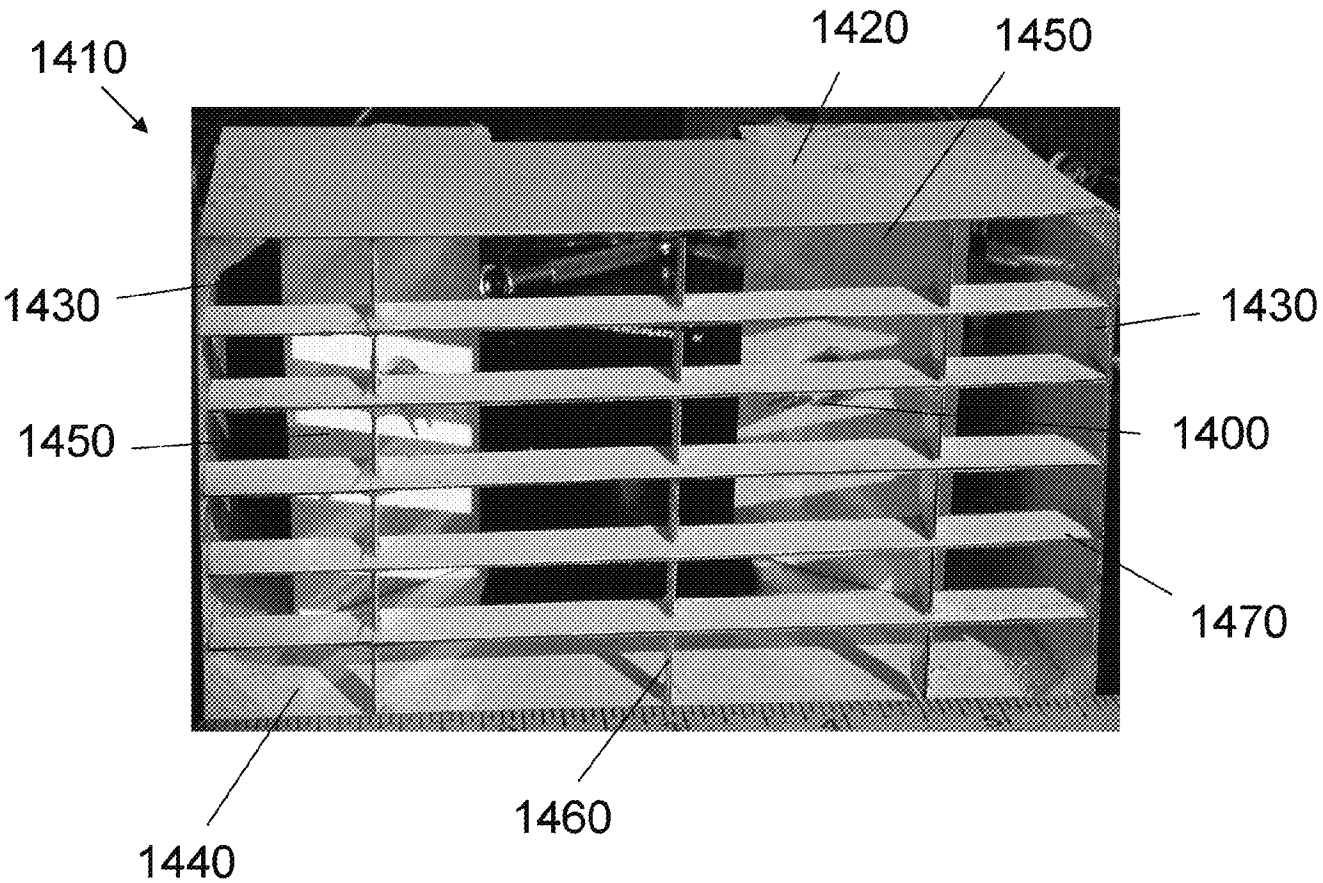
FIGS. 14A to 14C show an SCIS placed behind a device designed to prevent an operator from touching the SCIS according to an exemplary embodiment.
Figure 14B:
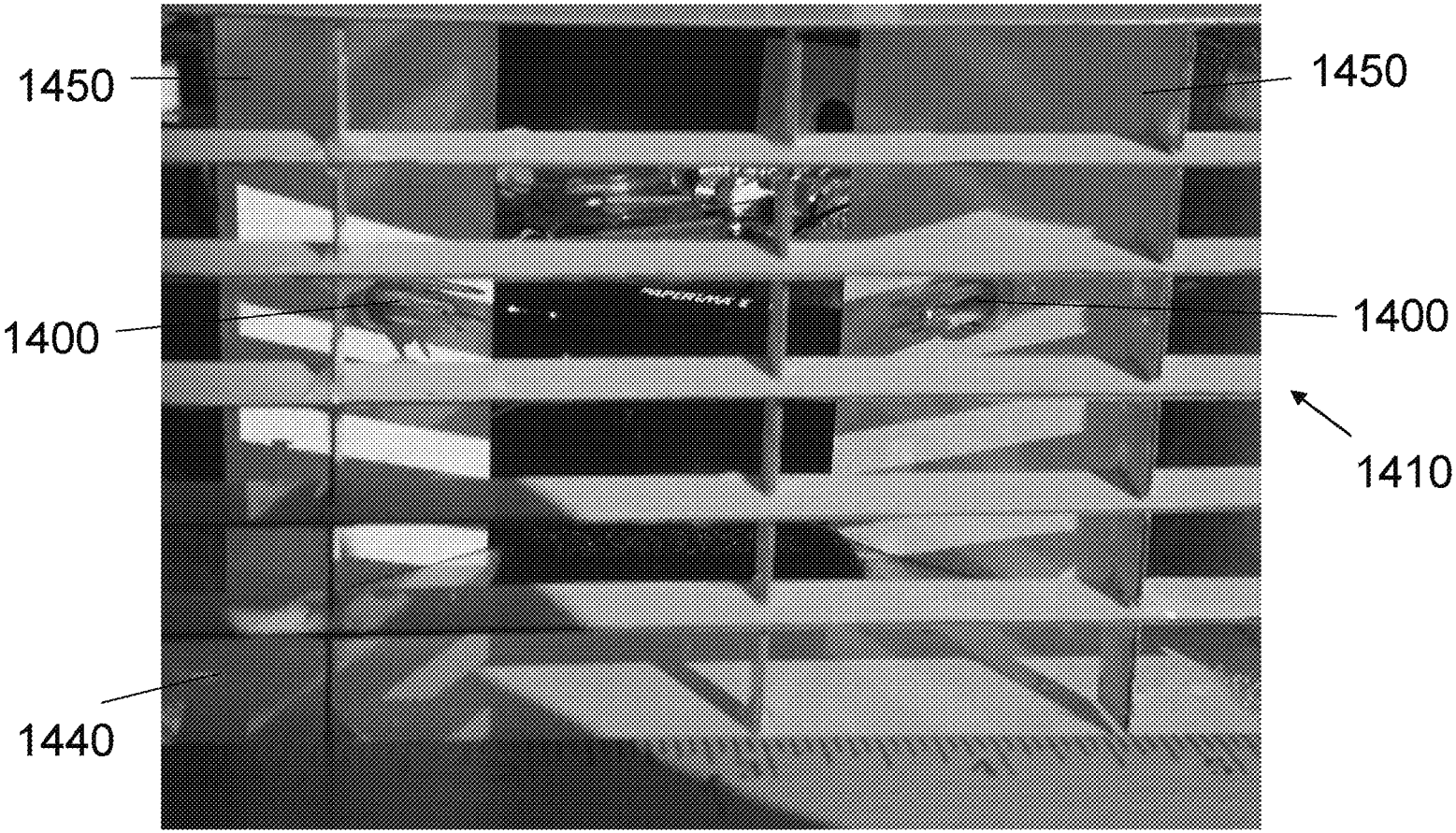
Figure 14C:
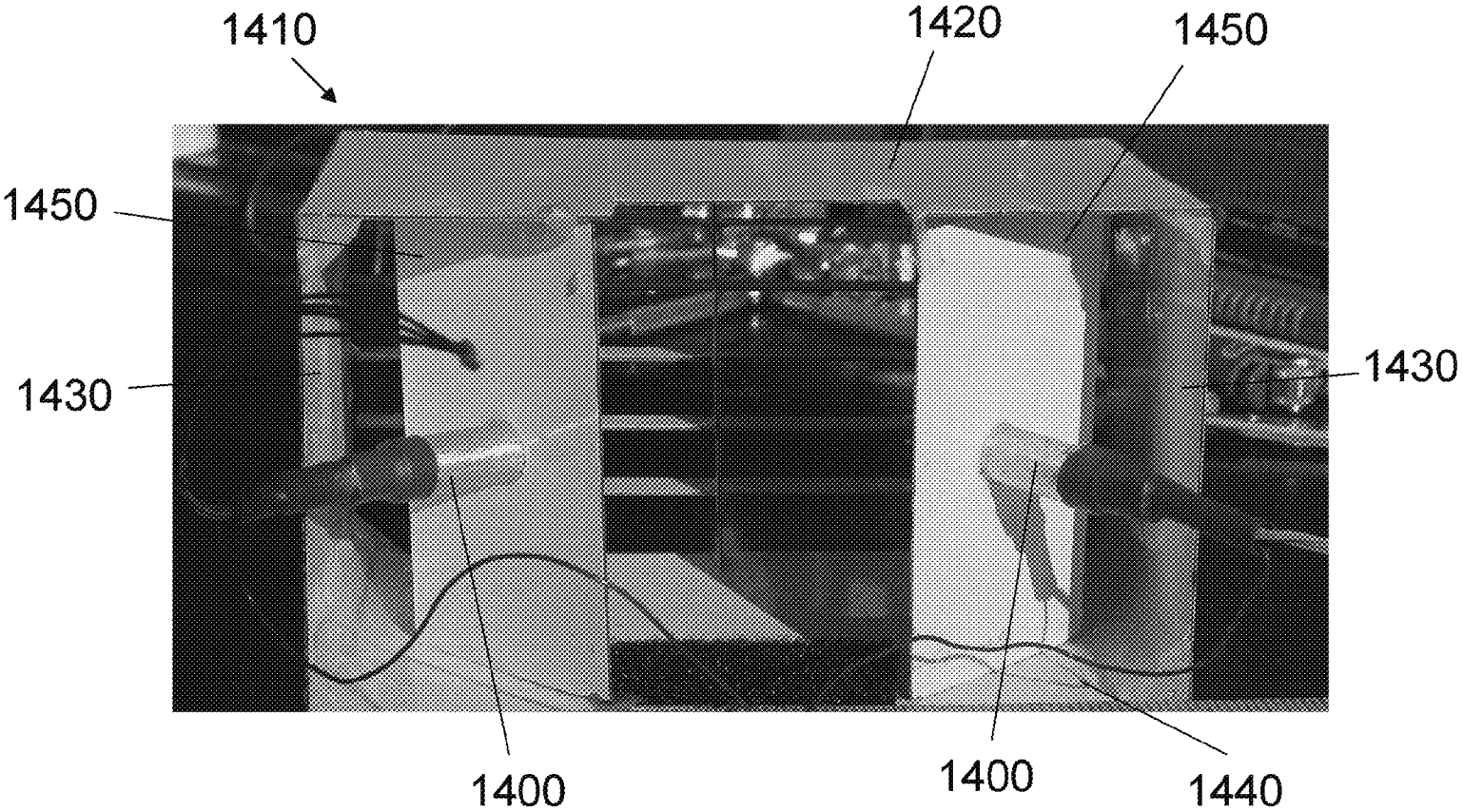

In another alternative embodiment, referring to FIGS. 14A to 14C, an SCIS device 1400 can be positioned behind a shield 1410 designed to prevent an operator from touching the SCIS device 1400 to ensure the performance of the SCIS device 1400 is not affected. FIG. 14A shows a frontal perspective view of the shield 1410, FIG. 14B shows a closer frontal perspective view of shield 1410, and FIG. 14C shows a rear perspective view of shield 1410. Shield 1410 has an upper surface 1420, two side surfaces 1430, and a lower surface 1440 that form an enclosure. A vertical support 1450 extending from the upper surface 1420 to the lower surface 1440 holds the SCIS device 1400 in position with the enclosure. In this exemplary embodiment, there are two SCIS devices 1400, so the shield 1410 has two vertical supports 1450. However, it is intended that the shield configuration can be varied depending upon the number of SCIS devices. Additionally, the orientation of the support can also be varied. In order to prevent contact with the SCIS device 1400, the enclosure has a plurality of vertical members 1460 extending from the upper surface 1420 to the lower surface 1440, a plurality of horizontal members 1470 extending from one side surface 1430 to the other side surface 1430. It is intended that the spacing, number, and configuration of vertical members 1460 and horizontal members 1470 can vary depending on the intended purpose and the configuration of the SCIS device.

Figure 15A:
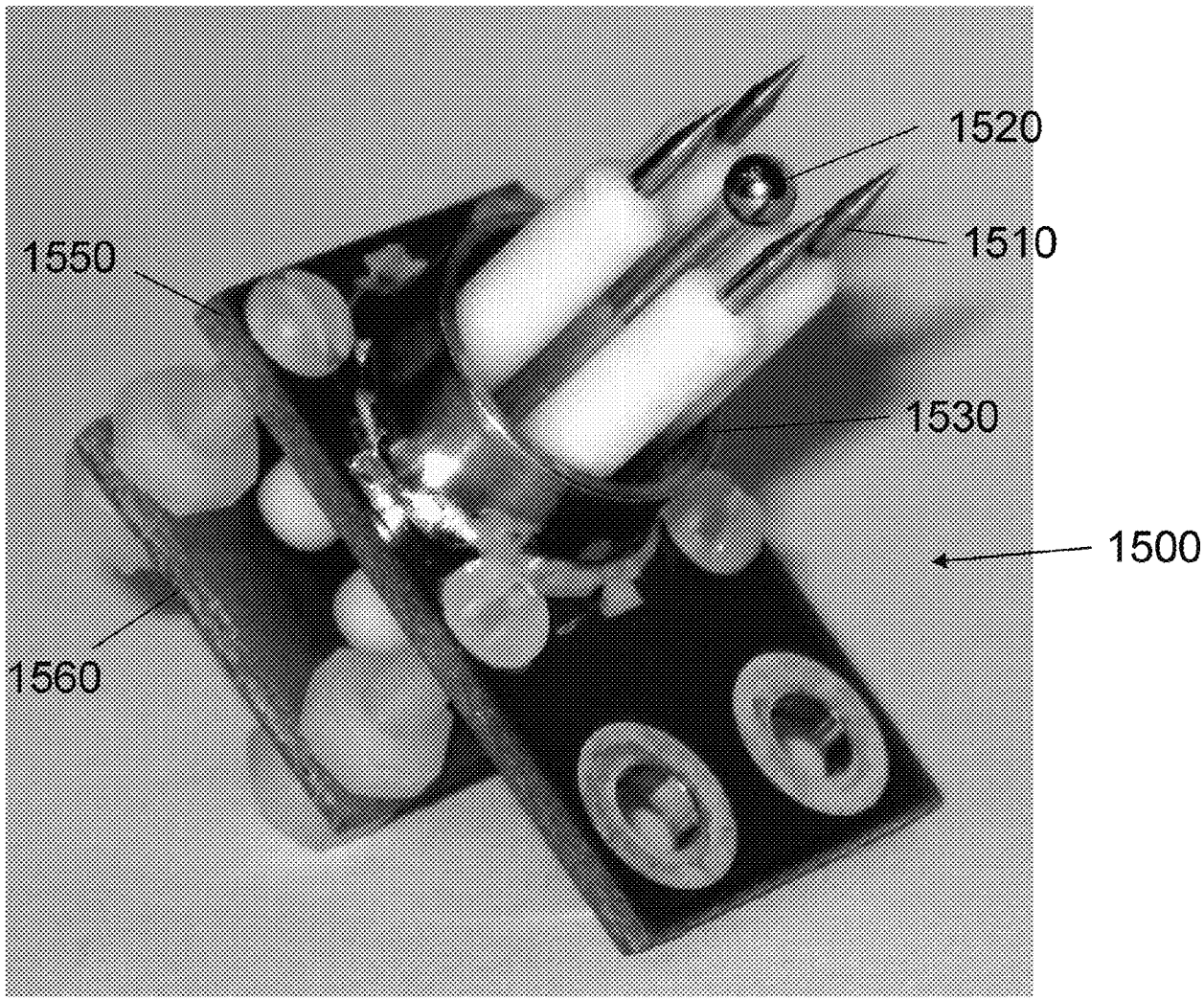
FIG. 15A shows a frontal perspective view of an SCIS mounted on two printed circuit boards.
Figure 15B:
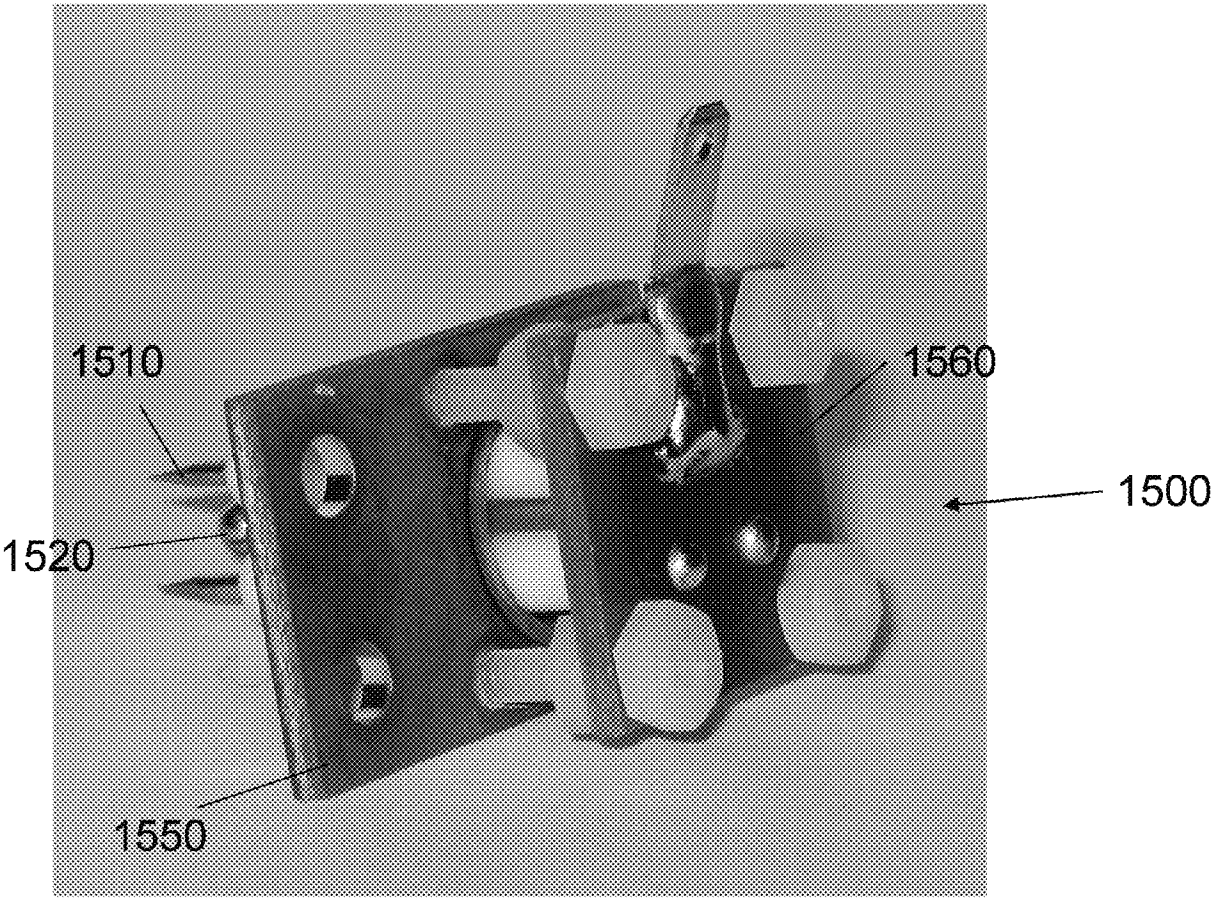
FIG. 15B shows a rear perspective view of an SCIS mounted on two printed circuit boards.

In another embodiment, the needles, center post, counter-electrode, and insulation can be mounted on two small printed circuit boards. As seen in FIGS. 15A and 15B, this configuration makes a SCIS device 1500 very easy to integrate into a system or platform from an installation and replacement perspective in that no wiring or soldering is needed—the device is simply fastened over electrical contacts. The construction of the SCIS device 1500 is divided into a forward plane 1550 and an aft plane 1560. The forward plane 1550 has a metal ring 1530 at a first potential. In this exemplary embodiment, the forward plane 1550 is 1.0 inch×0.5 inches. The aft plane 1560 has four needles 1510 to which a high voltage potential is applied (relative to the metal ring 1530). In this exemplary embodiment, the aft plane 1560 is 0.5 inches×0.5 inches. The planes are separated by insulating hardware affording the ability to adjust the distance between planes 1550, 1560 (and consequently the distance between the needles 1510 and the metal ring 1530). This allows the adjustment of the potential at which the SCIS device 1500 fires, as well as the current necessary to maintain ion production. The spacing between needles 1510, and the spacing between needles 1510 and the center post 1520, can be tightly controlled during printed circuit board manufacture. The overall part count, size, complexity, and manufacturability of the SCIS device 1500 are significantly reduced.

The embodiments described above are intended to be exemplary. One skilled in the art recognizes that numerous alternative components and embodiments may be substituted for the particular examples described herein and still fall within the scope of the invention. Other variations and modifications that are not specifically set out in the description herein will be apparent to those skilled in the art and the described invention is to be limited only by the scope of the following claims.

What is claimed is:

1. An ionization source assembly comprising:

a tube having a first end and a second end, wherein the tube is configured to receive a gas including a sample flowing into the first end of the tube;

an ionization source attached to the tube, the ionization source comprising:

a center post extending therefrom;

a plurality of needles extending from the ionization source, wherein the plurality of needles extend substantially parallel to the center post, wherein the center post is positioned substantially in the center of the plurality of needles, and wherein the plurality of needles are coupled to an electrical supply; and a counterelectrode ring extending around the ionization source, wherein the center post and the plurality of needles extend through the counterelectrode ring, and wherein the plurality of needles is configured to form a gas discharge upon application of a first voltage to the plurality of needles, and wherein the center post, the plurality of needles, and the counterelectrode ring are positioned inside of the tube and configured to be exposed to the gas including the sample entering the first end of the tube;

wherein the tube is configured to permit (a) the interaction of the reactant ions in the gas discharge and the sample to produce sample ions and (b) the exit of the sample ions from the second end of the tube.

2. The ionization source according to claim 1, wherein the gas further includes air.

3. The ionization source according to claim 1, wherein the ionization source further comprises a passageway for providing a second gas.

4. The ionization source according to claim 1, wherein the center post and the plurality of needles are substantially perpendicular to the flow of gas in the tube.

5. The ionization source according to claim 1, wherein the center post and the plurality of needles are substantially parallel to the flow of gas in the tube.

6. The ionization source according to claim 1, wherein the center post is coupled to an electrical supply.

7. The ionization source according to claim 1, wherein the needles, center post, and counterelectrode are mounted on at least one printed circuit board.

8. The ionization source according to claim 1, wherein the counterelectrode ring is coupled to an electrical supply.

* * * * *